US009725783B2

(12) United States Patent
Aiso et al.

(10) Patent No.: US 9,725,783 B2
(45) Date of Patent: Aug. 8, 2017

(54) STEEL FOR MACHINE STRUCTURE USE EXCELLENT IN CUTTING TOOL LIFETIME AND MACHINING METHOD OF SAME

(75) Inventors: Toshiharu Aiso, Tokyo (JP); Hajime Saitoh, Tokyo (JP); Atsushi Mizuno, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 95 days.

(21) Appl. No.: 12/998,593

(22) PCT Filed: May 14, 2010

(86) PCT No.: PCT/JP2010/058574

§ 371 (c)(1),
(2), (4) Date: May 5, 2011

(87) PCT Pub. No.: WO2010/134583

PCT Pub. Date: Nov. 25, 2010

(65) Prior Publication Data

US 2011/0239835 A1 Oct. 6, 2011

(30) Foreign Application Priority Data

May 22, 2009 (JP) ..... 2009-124471

(51) Int. Cl.
*B23C 3/00* (2006.01)
*C22C 38/06* (2006.01)
(Continued)

(52) U.S. Cl.
CPC ..... *C21D 9/22* (2013.01); *C22C 38/001* (2013.01); *C22C 38/02* (2013.01); *C22C 38/04* (2013.01);
(Continued)

(58) Field of Classification Search
None
See application file for complete search history.

(56) References Cited

U.S. PATENT DOCUMENTS 5,981,049 A 11/1999 Ohara et al.
2005/0025658 A1* 2/2005 Matsui et al. ..... 420/124
(Continued)

FOREIGN PATENT DOCUMENTS

JP S 55/138064 * 10/1980 ..... C22C 38/00
JP 5-212604 8/1993
(Continued)

OTHER PUBLICATIONS

English translation of J 2004-244665.*
(Continued)

*Primary Examiner* — Yoshitoshi Takeuchi
(74) *Attorney, Agent, or Firm* — Birch, Stewart, Kolasch & Birch, LLP

(57) ABSTRACT

Steel for machine structure use excellent in tool lifetime in a broad range of cutting speeds regardless of continuous machining, intermittent machining, or other systems and further in various machining environments such as use of a cutting fluid or a dry, semidry, and oxygen enriched environment, having a chemical composition containing, by mass %, C: 0.01 to 1.2%, Si: 0.005 to 3.0%, Mn: 0.05 to 3.0%, P: 0.0001 to 0.2%, S: 0.0001 to 0.35%, N: 0.0005 to 0.035%, and Al: 0.05 to 1.0%, satisfying [Al %]−(27/14)×[N %]≥0.05%, and having a balance of Fe and unavoidable impurities and forming an $Al_2O_3$ coating on the surface of a cutting tool by machining using a cutting tool coated on the surface contacting the machined material by metal oxides with a value of a standard free energy of formation at 1300° C. of that value of $Al_2O_3$ or more, and a machining method of the same.

14 Claims, 3 Drawing Sheets

(51) Int. Cl.

| | |
|---|---|
| ***C22C 38/04*** | (2006.01) |
| ***C22C 38/02*** | (2006.01) |
| ***C21D 9/22*** | (2006.01) |
| ***C22C 38/00*** | (2006.01) |
| ***C22C 38/60*** | (2006.01) |
| ***C23C 10/28*** | (2006.01) |
| *C21D 7/08* | (2006.01) |

(52) U.S. Cl.

CPC ..... *C22C 38/06* (2013.01); *C22C 38/60* (2013.01); *C23C 10/28* (2013.01); *C21D 7/08* (2013.01); *C21D 2261/00* (2013.01); *Y10T 83/04* (2015.04); *Y10T 83/0443* (2015.04)

(56) References Cited

U.S. PATENT DOCUMENTS

| | | | | |
|---|---|---|---|---|
| 2006/0257691 | A1* | 11/2006 | Trinh et al. | 428/698 |
| 2009/0311125 | A1* | 12/2009 | Miyanishi et al. | 420/83 |

FOREIGN PATENT DOCUMENTS

| | | | | |
|---|---|---|---|---|
| JP | 05-212604 | | 8/1993 | |
| JP | 10-158861 | | 6/1998 | |
| JP | 2002-192402 | | 7/2002 | |
| JP | 2004-244665 | * | 9/2004 | C22C 38/00 |
| JP | 2004-277818 | * | 10/2004 | C22C 38/00 |
| JP | 2004277818 | * | 10/2004 | C22C 38/00 |
| JP | 2008-13788 | | 1/2008 | |
| JP | 2008-36769 | | 2/2008 | |
| KR | 10-0755772 | | 8/2007 | |
| SE | WO8001487 | * | 7/1980 | C22C 29/00 |
| WO | WO 2008/130054 | | 10/2008 | |
| WO | WO2008/130054 | | 10/2008 | |

OTHER PUBLICATIONS

English translation of JP 05-212604.*

Cutting Fluid Characteristic (Cutting Fluid Characteristic, http://www.mfg.mtu.edu/cyberman/metal_fluids/charact.html (2008).*

English translation of JP 2004-277818 (2004).*

English translation of Katou et al (JPS 55/138064) (1980).*

English translation of JP2004277818 (2004).*

International Search Report dated Aug. 10, 2010 issued in corresponding PCT Application No. PCT/JP2010/058574.

Third Edition Steel Handbook, vol. I, Fundamentals, edited by Iron and Steel Institute of Japan, published by Maruzen, 1981, pp. 14-15.

Search Report dated Apr. 28, 2014 issued in European Patent Application No. 10777815.1.

Peckner, D. et al., "Handbook of Stainless Steels, Passage", Handbook of Stainless Steels, Jan. 1, 1977, p. 14.02, XP002053955.

First page of Korean Office Action, dated Feb. 1, 2013, issued in corresponding Korean application No. 10-2011-7010540.

* cited by examiner (a)

(b)

(c)

(a)

(b)

(c)

STEEL FOR MACHINE STRUCTURE USE EXCELLENT IN CUTTING TOOL LIFETIME AND MACHINING METHOD OF SAME

This application is a national stage application of International Application No. PCT/JP2010/058574, filed 14 May 2010, which claims priority to Japanese Application No. 2009-124471, filed 22 May 2009, which is incorporated by reference in its entirety.

TECHNICAL FIELD

The present invention relates to steel for machine structure use excellent in cutting tool lifetime and a machining method of the same.

BACKGROUND ART

In recent years, progress has been made in increasing the strength of steel. On the other hand, the problem has arisen of a drop in the machinability. For this reason, there is a rising need for steel holding the strength while preventing a drop in the machining efficiency.

In the past, to improve the machinability of steel, there is the method of adding Pb or S as an ingredient, but Pb has the problem of environmental load. With S, there is the problem that if increasing the amount added, the mechanical properties are degraded.

Further, the fact that by the addition of Ca, the oxides in the steel are softened and are made to deposit on the tool surface during machining so as to protect the tool, the so-called "belag", is utilized in accordance with need. However, with use of the belag, there are many limits on the machining conditions and ingredients. This is therefore not generally used.

With this as the backdrop, free cutting steels of new compositions of ingredients and machining methods of the same have been disclosed.

PLT 1 discloses steel for machine structure use which defines the ingredients of steel for machine structure use in a predetermined range so as to give an excellent machinability in a broad cutting speed region and give both high impact characteristics and a high yield ratio.

PLT 2 discloses a machining method for steel for machine structure use excellent in tool lifetime in intermittent machining which cuts steel for machine structure use of a predetermined composition of ingredients by a predetermined tool and contact time and non-contact time for steel for machine structure use by a cutting speed of 50 m/min or more so as to form a protective film mainly comprised of oxides on the tool surface.

CITATION LIST

Patent Literature

PLT 1: Japanese Patent Publication (A) No. 2008-13788
PLT 2: Japanese Patent Publication (A) No. 2008-36769

SUMMARY OF INVENTION

Technical Problem

However, in the prior art, there have been the following problems.

In the invention described in PLT 1, by adjusting the amounts of addition of Al and other nitride-forming elements and N and performing suitable heat treatment, the solute N harmful to the machinability is kept low. Further, suitable amounts of solute Al for improving the machinability by high temperature embrittlement and AlN for improving the machinability by a high temperature embrittlement effect and a cleaving type crystal structure are secured. As a result, a superior machinability is obtained for a broad range of cutting speeds from a low speed to a high speed.

However, only the steel ingredients are defined. The specific machining method and machining conditions are not disclosed.

In the invention described in PLT 2, for formation of a protective film having the effect of suppression of tool wear, it is necessary that the oxygen from the atmosphere diffuse to the contact surfaces of the tool and the machined material. For this reason, with the system of continuous machining where steel for machine structure use and swarf continuously contact the tool and the oxygen from the atmosphere has difficulty diffusing to the contact surfaces of the tool and machined material, the effect of improvement of the tool lifetime cannot be obtained.

Further, if the cutting speed is less than 50 m/min, the effect is small. Further, use of a cutting fluid or other lubrication oil is also limited to the minimum extent.

Therefore, in continuous machining like drilling or turning, often used in the production of parts for machine structure use, where oxygen from the atmosphere has difficulty diffusing to the contact surfaces of the tool and machined material, it is impossible to extend the tool lifetime.

In steel for machine structure use, drilling, turning, tapping, and other continuous machining and end milling, hobbing, and other intermittent machining and other various machining operations are performed. Along with this, the cutting speeds are broad in range. Further, there are various machining environments as well such as use of cutting fluids and dry, semidry, and oxygen enriched environments. However, no technique has been proposed for extending the tool lifetime under all machining conditions.

The present invention was made in consideration of the above-mentioned problem and has as its object the provision of steel for machine structure use excellent in tool lifetime under a broad range of cutting speeds regardless of the continuous machining, intermittent machining, or other system and further under various machining environments such as use of a cutting fluid and dry, semidry, and oxygen enriched environments and a machining method for the same.

Solution to Problem

The inventors engaged in intensive research to solve the above problems and as a result found the following new discoveries.

(a) If increasing the amount of Al in the steel ingredients and machining by using a tool coated with metal oxides with a standard free energy of formation at 1300° C. larger than the standard free energy of formation of $Al_2O_3$, the solute Al in the steel and the metal oxides at the tool surface undergo a chemical reaction, an $Al_2O_3$ coating is formed on the tool surface, and a superior lubricating ability and tool lifetime are obtained due to the $Al_2O_3$ coating.

(b) Even if machining using a tool coated with metal oxides with a standard free energy of formation at 1300° C. larger than the standard free energy of formation of $Al_2O_3$, if the amount of solute Al is small, an $Al_2O_3$ coating of a sufficient thickness for imparting wear resistance to a tool cannot be obtained and the tool lifetime is not improved. Specifically, if the solute Al is 0.05 mass % or more, an $Al_2O_3$ coating of a sufficient thickness is obtained.

(c) Even when the solute Al in the steel is 0.05 mass % or more, if machining by a tool covered by metal oxides with a standard free energy of formation at 1300° C. of the standard free energy of formation of $Al_2O_3$ or less or if machining by a tool not including oxides at the tool surface, no chemical reaction occurs for formation of $Al_2O_3$ and the tool lifetime is not improved.

The present invention was obtained as a result of further detailed study based on the above discoveries and has as its gist the following:

(1) Steel for machine structure use containing, by mass %,
C: 0.01 to 1.2%,
Si: 0.005 to 3.0%,
Mn: 0.05% to 3.0%,
P: 0.0001 to 0.2%,
S: 0.0001 to 0.35%,
Al: 0.05 to 1.0%, and
N: 0.0005 to 0.035%,
satisfying $$[Al\ \%]-(27/14)\times[N\ \%]\geq 0.05\%, \text{ and}$$

having a balance of Fe and unavoidable impurities, whereby, by this steel being machined by a cutting tool coated, on its surface contacting the machined material, by metal oxides having a standard free energy of formation at 1300° C. larger than the standard free energy of formation of $Al_2O_3$, an $Al_2O_3$ coating is formed on the surface of the cutting tool.

(2) Steel for machine structure use as set forth in (1), wherein the steel further contains, by mass %,
Ca: 0.0001 to 0.02%.

(3) Steel for machine structure use as set forth in (1) or (2), wherein the steel further contains, by mass %, one or more of:
Ti: 0.0005 to 0.5%,
Nb: 0.0005 to 0.5%,
W: 0.0005 to 1.0%,
V: 0.0005 to 1.0%,
Ta: 0.0001 to 0.2%,
Hf: 0.0001 to 0.2%,
Cr: 0.001 to 3.0%,
Mo: 0.001 to 1.0%,
Ni: 0.001 to 5.0%, and
Cu: 0.001 to 5.0%.

(4) Steel for machine structure use as set forth in (1) or (2), wherein the steel further contains, by mass %, one or more of:
Mg: 0.0001 to 0.02%,
Zr: 0.0001 to 0.02%, and
Rem: 0.0001 to 0.02%.

(5) Steel for machine structure use as set forth in (3), wherein the steel further contains, by mass %, one or more of:
Mg: 0.0001 to 0.02%,
Zr: 0.0001 to 0.02%, and
Rem: 0.0001 to 0.02%.

(6) Steel for machine structure use as set forth in (1) or (2), wherein the steel further contains, by mass %, one or more of:
Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(7) Steel for machine structure use as set forth in (3), wherein the steel further contains, by mass %, one or more of:
Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(8) Steel for machine structure use as set forth in (4), wherein the steel further contains, by mass %, one or more of:
Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(9) Steel for machine structure use as set forth in (5), wherein the steel further contains, by mass %, one or more of:
Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(10) Steel for machine structure use as set forth in (1) or (2), wherein the metal oxides having a standard free energy of formation at 1300° C. larger than the standard free energy of formation of $Al_2O_3$ are oxides including oxides of Ti, V, Cr, Mn, Fe, Co, Ni, Cu, Nb, Mo, Ta, W, Si, Zn, and Sn or oxides including two or more types of metal elements among these elements.

(11) Steel for machine structure use as set forth in (1) or (2), wherein the cutting tool coated with the metal oxides on the surface contacting the machined material is fabricated by either PVD or CVD.

(12) Steel for machine structure use as set forth in (1) or (2), wherein the thickness of the metal oxides coated on the cutting tool is 50 nm to less than 1 μm.

(13) Steel for machine structure use as set forth in (1) or (2), wherein in the machining, a cutting fluid or other lubrication oil is used.

(14) Steel for machine structure use as set forth in (13), wherein the
cutting fluid or other lubrication oil is a water-insoluble cutting fluid.

(15) Steel for machine structure use as set forth in (1) or (2), wherein the machining is continuous machining.

(16) A machining method for steel for machine structure use comprising machining steel for machine structure use containing, by mass %, C: 0.01 to 1.2%,
Si: 0.005 to 3.0%,
Mn: 0.05% to 3.0%,
P: 0.0001 to 0.2%,
S: 0.0001 to 0.35%,
Al: 0.05 to 1.0%, and
N: 0.0005 to 0.035%,
satisfying $$[Al\ \%]-(27/14)\times[N\ \%]\geq 0.05\%, \text{ and}$$

having a balance of Fe and unavoidable impurities, using a cutting tool coated, on its surface contacting the machined material, by metal oxides having a standard free energy of formation at 1300° C. larger than the standard free energy of formation of $Al_2O_3$.

(17) A machining method for steel for machine structure use of (16), wherein the steel for machine structure use further contains, by mass %, Ca: 0.0001 to 0.02%.

(18) A machining method for steel for machine structure use of (16) or (17), wherein the steel for machine structure use further contains, by mass %, one or more of Ti: 0.0005 to 0.5%,
Nb: 0.0005 to 0.5%,
W: 0.0005 to 1.0%,
V: 0.0005 to 1.0%,
Ta: 0.0001 to 0.2%,
Hf: 0.0001 to 0.2%,
Cr: 0.001 to 3.0%,
Mo: 0.001 to 1.0%,
Ni: 0.001 to 5.0%, and
Cu: 0.001 to 5.0%.

(19) A machining method for steel for machine structure use of (16) or (17), wherein the steel for machine structure use further contains, by mass %, one or more of Mg: 0.0001 to 0.02%,
Zr: 0.0001 to 0.02%, and
Rem: 0.0001 to 0.02%.

(20) A machining method for steel for machine structure use of (18), wherein the steel for machine structure use further contains, by mass %, one or more of Mg: 0.0001 to 0.02%,
Zr: 0.0001 to 0.02%, and
Rem: 0.0001 to 0.02%.

(21) A machining method for steel for machine structure use of (16) or (17), wherein the steel for machine structure use further contains, by mass %, one or more of Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(22) A machining method for steel for machine structure use of (18), wherein the steel for machine structure use further contains, by mass %, one or more of Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(23). A machining method for steel for machine structure use of (19), wherein the steel for machine structure use further contains, by mass %, one or more of Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(24) A machining method for steel for machine structure use of (20), wherein the steel for machine structure use further contains, by mass %, one or more of Sb: 0.0001 to 0.015%,
Sn: 0.0005 to 2.0%,
Zn: 0.0005 to 0.5%,
B: 0.0001 to 0.015%,
Te: 0.0003 to 0.2,
Se: 0.0003 to 0.2,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, and
Sr: 0.00001 to 0.005%.

(25) A machining method for steel for machine structure use of (16) or (17), wherein the metal oxides having a standard free energy of formation at 1300° C. larger than the standard free energy of formation of $Al_2O_3$ are oxides including oxides of Ti, V, Cr, Mn, Fe, Co, Ni, Cu, Nb, Mo, Ta, W, Si, Zn, and Sn or oxides including two or more types of metal elements among these elements.

(26) A machining method for steel for machine structure use of (16) or (17), wherein the cutting tool coated with the metal oxides on the surface contacting the machined material is fabricated by either PVD or CVD.

(27) A machining method for steel for machine structure use of (16) or (17), wherein the thickness of the metal oxides coated on the cutting tool is 50 nm to less than 1 μm.

(28) A machining method for steel for machine structure use of (16) or (17), wherein in the machining, a cutting fluid or other lubrication oil is used.

(29) A machining method for steel for machine structure use of (28), wherein the cutting fluid or other lubrication oil is a water-insoluble cutting fluid.

(30) A machining method for steel for machine structure use of (16) or (17), wherein the machining is continuous machining.

Advantageous Effects of Invention

According to the present invention, it is possible to provide steel for machine structure use giving a superior lubricating ability and tool lifetime, by formation of an $Al_2O_3$ coating by a chemical reaction on the tool surface, under a broad range of cutting speeds regardless of the continuous machining, intermittent machining, or other system and further under various machining environments such as use of a cutting fluid or dry, semidry, and oxygen enriched environment and a machining method for the same.

DESCRIPTION OF EMBODIMENTS

Figure 1:
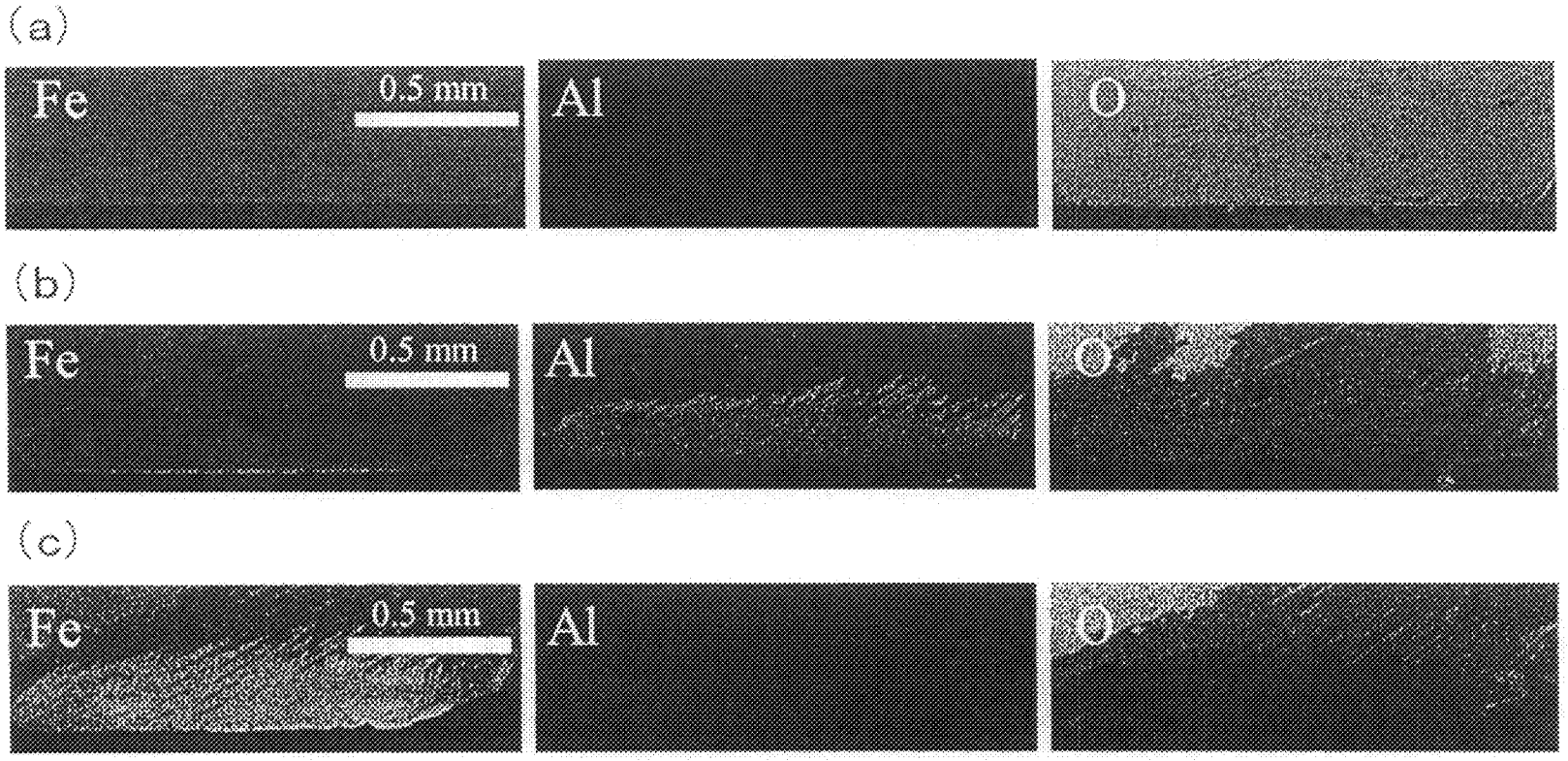
FIG. 1 gives SEM-EDS images of the vicinities of the cutting edges of tools after machining steels differing in amounts of solute Al using drills made by high speed steel coated on the surface layers by $Fe_3O_4$ coatings by homo treatment.

Below, embodiments of the present invention will be explained in detail.

The present invention provides steel for machine structure use characterized by forming an $Al_2O_3$ coating on the surface of a cutting tool when using a cutting tool having a surface layer coating comprised of predetermined metal oxides for machining steel for machine structure use having a predetermined composition of ingredients and a machining method of the same.

First, details of the composition of ingredients of the steel for machine structure use and the surface coating of a tool will be explained.

In machining of a ferrous metal material, the machined material undergoes large plastic deformation at the tool edge whereby swarf is produced and separates from the machined material. About 95% of the energy used in this plastic deformation disperses as heat.

The cutting speed is generally several 10 m/min or more, so the plastic deformation becomes a high strain rate deformation of a strain rate of 1000/sec or more. As a result, there is not sufficient time for diffusion of the heat.

In machining, large strain deformation at a high speed is performed concentrated locally, so the temperature in the deformation region rises and the temperature at the contact surfaces of the tool and steel material becomes several 100° C. to 1000° C. or more. Furthermore, the contact surfaces of the tool and steel material become a high pressure state.

At the high temperature, high pressure contact surfaces, a chemical reaction is promoted between the contact surfaces and the tool surface becomes worn. This reaction is called "diffusion wear" or "chemical wear" depending on the type of reaction.

For example, if machining carbon steel by a cemented alloy tool having WC and Co as main ingredients, the WC in the cemented alloy breaks down and the C diffuses to the carbon steel side or the Co flows out to the interfaces. The Fe diffuses from the carbon steel side to the cemented alloy side and forms a complicated reaction product near the interface between the tool and the machined material.

Such a reaction product is generally weaker than the base material. Further, the surrounding bonding phase falls in strength, so is easily carried away along with the swarf resulting in further progression of the tool wear.

In this way, in the past, the chemical reaction occurring at the contact surfaces of the tool and steel material caused tool wear. The inventors discovered a method of effectively using a chemical reaction usually causing tool wear so as to prevent tool wear.

To increase the wear resistance of a cutting tool, a tool made of a base material of cemented alloy, high speed steel, etc. which is given a hard ceramic coating is often used.

Among these, in general, $Al_2O_3$ coated by CVD is hard and excellent in oxidation resistance, so greatly improves the tool lifetime.

Therefore, the inventors engaged in intensive research on a method using a chemical reaction during machining so as to form an $Al_2O_3$ coating on the tool surface and thereby suppress tool wear.

Usually, Al is added as a deoxidizing element to the steel and/or is added for the purpose of prevention of coarsening of the crystal grains by AlN. If adding more than the amount of Al required for these purposes, the Al becomes solute Al in the steel.

The inventors confirmed that if machining steel containing a large amount of solute Al using a tool covered by oxides made of a metal element with an affinity with oxygen larger than Al, that is, metal oxides with a standard free energy of formation larger than the value of $Al_2O_3$, a chemical reaction occurs at the contact surfaces between the tool and steel material and an $Al_2O_3$ coating is formed at the tool surface layer. They did this by analyzing the tool surface after machining by SEM-EDS or Auger electron spectroscopy.

As an example, FIG. 1 shows the results of machining steel containing a large amount of solute Al (0.12 mass % Al–0.0050 mass % N) and steel not containing much solute Al (0.03 mass % Al–0.0050 mass % N) by a drill made of high speed steel treated by steam treatment called "homo treatment" to form an $Fe_3O_4$ coating of a thickness of 5 μm on the tool surface layer and analyzing the tool surface near the tool cutting edge after machining by SEM-EDS. In FIG. 1, the brighter the color, the higher the concentration of the element shown in the figure.

FIG. 1(*a*) shows an unused tool. At the tool surface layer, the homo treatment results in the presence of $Fe_3O_4$ with a standard free energy of formation larger than the standard free energy of formation of $Al_2O_3$. Fe and O are observed.

FIG. 1(*b*) shows a tool machining a steel material including a large amount of solute Al. Al is observed on the tool surface. When analyzing the region where Al is observed by Auger electron spectroscopy, Al and O were present at the same positions and the composition became one close to $Al_2O_3$. From the results, it was learned that $Al_2O_3$ was formed on the tool surface.

FIG. 1(*c*) shows a tool machining a steel material not including much of an amount of solute Al. Near the cutting edge, a region where O is not observed and the concentration of Fe is high is observed. This shows that due to the progression of tool wear, the $Fe_3O_4$ at the surface layer is consumed and the high speed steel of the base material is exposed or the swarf sticks.

Figure 2:
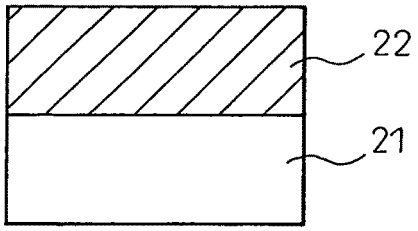
FIG. 2 gives views showing cross-sections of tool edges after machining steels differing in amounts of solute Al using drills made by high speed steel coated on the surface layers by $Fe_3O_4$ coatings by homo treatment.
Figure 2:
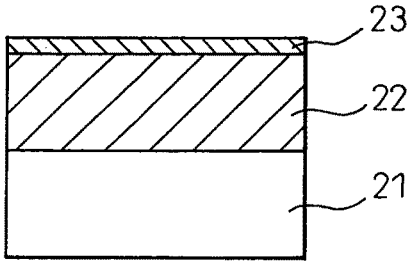
Figure 2:
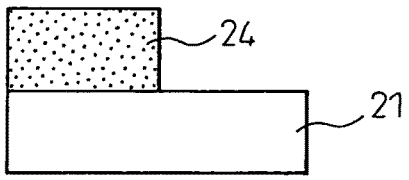

FIG. 2 schematically shows the cross-sectional structure near the tool edge after machining. FIG. 2(*a*) shows an unused tool. FIG. 2(*b*) shows a tool machining a steel material containing a large amount of solute Al.

FIG. 2(*c*) shows a tool machining a steel material not containing much solute Al. The direction above the paper surface shows the tool surface side, while the direction below the paper surface shows the tool base material side.

FIG. 2(*b*) shows the state where the solute Al and $Fe_3O_4$ 22 chemically react resulting in the formation of an $Al_2O_3$ coating 23 on the $Fe_3O_4$ coating 22 and coverage of the tool surface. The formed $Al_2O_3$ coating 23 suppresses the tool wear.

On the other hand, FIG. 2(*c*) shows the state where wear progresses, the $Fe_3O_4$ coating 22 is consumed, and the high speed steel 21 of the base material is exposed at the surface or the swarf 24 partially stick.

Figure 3:
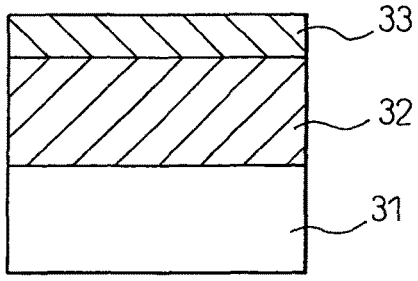
FIG. 3 gives views showing cross-sections of tool edges after machining steels differing in amounts of solute Al using tools given $TiO_2$ coatings on the surface layers of TiAlN coatings.
Figure 3:
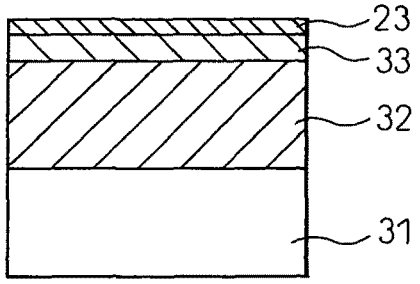
Figure 3:
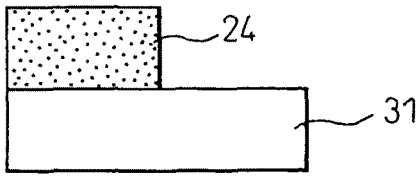

As another example, FIG. 3 schematically shows the cross-sectional structure near the tool cutting edge after machining steel containing a large amount of solute Al (0.12 mass % Al-0.0050 mass % N) and steel not containing much solute Al (0.03 mass % Al-0.0050 mass % N) using a cemented alloy tool 31 given an TiAlN coating 32 at the surface layer of which a $TiO_2$ coating 33 of a thickness of 200 nm is further given.

FIG. 3(*a*) shows an unused tool. FIG. 3(*b*) shows a tool machining a steel material containing a large amount of solute Al. FIG. 3(*c*) shows a tool machining a steel material not containing much solute Al.

FIG. 3(*b*) shows the state where the solute Al and $TiO_2$ chemically react whereby an $Al_2O_3$ coating 23 is formed on the $TiO_2$ coating 33 and the tool surface is covered. The formed $Al_2O_3$ coating 23 suppresses tool wear.

FIG. 3(*c*) shows the state where wear progresses, the $TiO_2$ coating 33 and TiAlN coating 32 at the surface layer are consumed, and the cemented alloy 31 of the base material is exposed at the surface or the swarf 24 partially stick.

As will be understood from the above examples, if machining steel containing a large amount of solute Al by a tool coated by metal oxides with a standard free energy of formation larger than the standard free energy of formation of $Al_2O_3$, an $Al_2O_3$ coating is formed on the tool surface. As a result, the wear resistance of the tool is improved and the tool wear is suppressed, so the tool lifetime is improved.

The above is a new discovery never known before and made by the inventors.

Before this discovery was obtained, it was assumed that, for example, when, as shown in FIG. 3, the tool surface layer coating was made of $TiO_2$ or other oxides stabler than $Fe_3O_4$, that is, oxides with a standard free energy of formation smaller than the standard free energy of formation of $Fe_3O_4$, the chemical reaction with the solute Al became harder and an $Al_2O_3$ coating was not formed on the tool surface.

Furthermore, the $Fe_3O_4$ coating formed in the homo treatment has a thickness of a relatively thick about 5 μm. For this reason, it was assumed that when the oxide coating is thin like in the case of FIG. 3, the $Al_2O_3$ coating formed on the tool surface was thin and tool wear was not suppressed.

The fact that even when the tool is coated by oxides other than $Fe_3O_4$ formed by homo treatment and the thickness of the coating is a thin 200 nm, by optimizing the composition of ingredients of the steel and coating the tool by a suitable surface layer coating, it is possible to suppress tool wear by the formation of the $Al_2O_3$ coating, is a particularly new finding discovered by the inventors.

By machining steel of a predetermined composition of ingredients by a tool coated by a predetermined surface layer coating, the tool lifetime in machining the steel for machine structure use is improved.

Next, the reasons for defining the surface layer coating of the tool used for machining the steel for machine structure use will be explained.

The characterizing features of the steel for machine use of the present invention and the machining method of the same lie in the point of using a cutting tool coated on the surface contacting the machined material by metal oxides with a standard free energy of formation at 1300° C. larger than a standard free energy of formation of $Al_2O_3$ and the point that when using that cutting tool for machining, an $Al_2O_3$ coating is formed on the surface of the cutting tool.

During machining, the contact surfaces of the tool and steel material form a high temperature, high pressure environment and a chemical reaction occurs between the tool and the steel material.

If using a tool covered at the surface contacting the machined material by metal oxides with a standard free energy of formation at 1300° C. larger than the standard free energy of formation of $Al_2O_3$ so as to machine the steel for machine structure use of the present invention, the solute Al in the steel and the metal oxides at the tool surface layer undergo a chemical reaction whereby an $Al_2O_3$ coating is formed at the tool surface.

An $Al_2O_3$ coating is hard, so acts as a protective film, suppresses the tool wear, and improves the tool lifetime as an effect.

Furthermore, an $Al_2O_3$ coating has a large affinity with the MnS-based inclusions in the steel and exhibits the effects of selectively depositing MnS-based inclusions on the tool surface, so imparts a lubricating ability.

The temperature of the contact surfaces of the tool and steel material during machining reaches from several 100° C. to 1000° C. or more. When examining the swarf produced when machining in the range of the present invention, no melt tracks could be seen. From this, it is considered that the temperature of the contact surfaces does not reach the melting point.

Therefore, for the standard free energy of formation of metal oxides, it was decided to use the value at 1300° C.

Metal oxides with a standard free energy of formation larger than the standard free energy of formation of $Al_2O_3$ are metal oxides which are more easily reduced to metal compared with $Al_2O_3$.

As metal oxides with a standard free energy of formation at 1300° C. larger than the standard free energy of formation of $Al_2O_3$, for example, Ti, V, Cr, Mn, Fe, Co, Ni, Cu, Nb, Mo, Ta, W, Si, Zn, Sn, or other oxides and oxides including two or more types of metal elements among these elements may be mentioned.

The "standard free energy of formation at 1300° C." of metal oxides can be found by the formula of Table 1-1 described in *Third Edition Steel Handbook, Vol. I, Fundamentals*, Jun. 20, 1981, edited by Iron and Steel Institute of Japan, published by Maruzen, pages 14 to 15.

For example the standard free energies of formation at 1300° C. ΔG of $Al_2O_3$ and NiO are found as follows:

(a) Standard free energy of formation at 1300° C. of $Al_2O_3$ $$\Delta G=-1121.94+0.21630\times(1300+273)=-782\ (\text{kJ})$$

(b) Standard free energy of formation at 1300° C. of NiO $$\Delta G=-465.74+0.16646\times(1300+273)=-204\ (\text{kJ})$$

The standard free energy of formation in the case where metal oxides include two or more types of metal elements is not shown in the above Table 1-1. In this case, the value of the oxides with the smallest standard free energy of formation among the oxides of the different metal elements is used.

For example, in the case of the metal oxides NiCrO including Ni and Cr, the standard free energy of formation of $Cr_2O_3$ is smaller than the standard free energy of formation of NiO, so the standard free energy of formation of $Cr_2O_3$ is used.

These metal oxides can be formed on the surface layer of a tool having tool steel, high speed steel, cemented alloy, cermet, ceramic, etc. as a base material. Further, they can be formed on the surface layer of a tool made using these as base materials further coated with a hard substance including one or a combination of TiN, TiC, TiCN, TiAlN, $Al_2O_3$, etc.

As the method for forming an $Fe_3O_4$ coating on the tool surface layer, there is "homo treatment" which uses steam treatment to form a $Fe_3O_4$ coating. This method is limited in application to tools of tool steel, high speed steel, or other ferrous materials and cannot be used for cemented alloy, cermet, ceramic, and tools coated with hard substances often used in machining of steel for machine structure use.

Accordingly, the metal oxides of the present invention are preferably made ones other than the $Fe_3O_4$ coating formed by homo treatment.

When depositing metal oxides using PVD, CVD, etc., it is possible to further form an $Al_2O_3$ coating not only at the surface layer of tools made by tool steel, high speed steel, cemented alloy, cermet, ceramic, etc. as a base material, but also on a multilayer coating such as in the example of FIG. 3. For this reason, it is possible to strikingly improve the wear resistance as compared with the case of use of homo treatment. Therefore, the metal oxides are preferably formed into a coating by CVD, ion plating, or other PVD.

Furthermore, when using PVD, compressive residual stress is introduced to the coating film, so the strength is improved and further the wear resistance is improved. Accordingly, formation by PVD is more preferable.

TO obtain a sufficient thickness of $Al_2O_3$ coating for reacting with the solute Al during machining to impart wear resistance to the tool, the thickness of the metal oxides coated on the tool is preferably made 10 nm or more. More preferably the thickness is made 50 nm or more.

If the thickness of the metal oxides coated on the tool is smaller than 10 nm, it is not possible to obtain a sufficient thickness of $Al_2O_3$ coating for imparting wear resistance to the tool and not possible to increase the tool lifetime.

If the thickness becomes 10 μm or more, peeling of the coating and notching and chipping of the tool easily occur, so less than 10 μm is preferable. The more preferable thickness is less than 5 μm, the more preferable thickness is less than 3 μm, and the still more preferable thickness is less than 1 μm.

If the thickness of the metal oxides is less than 500 nm, it can be measured by the Auger electron spectroscopy, while if it is 500 nm or more, it can be measured by FE-SEM.

The chemical reaction for forming the $Al_2O_3$ coating occurs between the metal oxides at the surface layer of the tool and the steel material, so the oxygen in the atmosphere is not required. For this reason, not only dry machining, mist lubrication, or other semidry machining and machining in an oxygen enriched atmosphere, but also use of cutting fluid or other lubricating oil or Ar and $N_2$ or another inert gas for cooling is effective even in a state easily cut off from the atmosphere and can be applied in a broad range of environments.

In particular, if using a cutting fluid or other lubricating oil, the lubricating ability further rises and the tool lifetime is improved.

Cutting fluids may be roughly divided into water-insoluble cutting fluids and water-soluble cutting fluids, but if using water-insoluble cutting fluids with a high lubrication effect, the lubricating ability is further enhanced and the tool lifetime is improved.

The chemical reaction for forming the $Al_2O_3$ coating does not require oxygen in the atmosphere, so this is particularly effective for drilling, turning, tapping, or other continuous machining where the steel for machine structure use and swarf continuously contact the tool and oxygen from the atmosphere is inhibited from diffusing to the contact surfaces of the tool and machined material.

In end milling, hobbing, and other intermittent machining as well, it is possible to similarly improve the tool lifetime.

Next, the reasons for limiting the composition of ingredients of the steel for machine structure use will be explained. Below, "%" means "mass %".

C has a large effect on the basic strength of steel materials. If the C content is less than 0.01%, sufficient strength cannot be obtained. If the C content is over 1.2%, a large amount of hard carbides precipitate, so the machinability remarkably falls. Accordingly, to obtain a sufficient strength and machinability, the C content is made 0.01 to 1.2%, preferably is made 0.05 to 0.8%.

Si is generally added as a deoxidizing element, but also has the effect of strengthening the ferrite and imparting temper-softening resistance. If the Si content is less than 0.005%, a sufficient deoxidizing effect cannot be obtained. If the Si content is over 3.0%, the toughness and ductility become lower and the machinability is degraded. Accordingly, the Si content is made 0.005 to 3.0%, preferably is made 0.01 to 2.2%.

Mn forms a solid solution in the matrix so as to improve the quenchability and secure the strength after quenching and simultaneously combines with the S in the steel to form MnS-based sulfides and improve the machinability as an effect. If the Mn content is less than 0.05%, the S in the steel combines with the Fe to form FeS resulting in the steel becoming brittle. If the Mn content is over 3.0%, the hardness of the material becomes greater and the workability falls. Accordingly, the Mn content is made 0.05 to 3.0%, preferably is made 0.2 to 2.2%.

P makes the machinability better. If the P content is less than 0.0001%, the effect cannot be obtained. If the P content is over 0.2%, the toughness is made to greatly deteriorate and simultaneously the hardness of the material becomes larger in the steel and not only the cold workability, but also the hot workability and casting characteristics decline. Accordingly, the P content is made 0.0001 to 0.2%, preferably is made 0.001 to 0.1%.

S combines with Mn to remain present as MnS-based sulfides. MnS improves the machinability. If the S is less than 0.0001%, the effect cannot be obtained. If the S content is over 0.35%, the toughness and the fatigue strength remarkably fall. Accordingly, the S content is made 0.0001 to 0.35%, preferably is made 0.001 to 0.2%.

N combines with Al, Ti, V, Nb, etc. to form nitrides or carbonitrides and suppress the coarsening of the crystal grains. If the N content is less than 0.0005%, the effect of suppressing the coarsening of the crystal grains is insufficient. If the N content is over 0.035%, the effect of suppressing the coarsening of the crystal grains becomes saturated, the hot ductability is remarkably deteriorated, and the production of the rolled steel material becomes extremely difficult. Accordingly, N is made 0.0005 to 0.035%, preferably is made 0.002 to 0.02%.

Al is the most important element in the present invention.

Al improves the internal quality of the steel material as a deoxidizing element. At the same time, the solute Al undergoes a chemical reaction with the metal oxides of the tool surface layer at the surface of the tool during machining to form an $Al_2O_3$ coating, so the lubricating ability and tool lifetime are improved.

If the Al content is less than 0.05%, solute Al effective for improving the tool lifetime is not sufficiently produced. If the Al content is over 1.0%, a large amount of high melting point, hard oxides is formed and increase the tool wear at the time of machining. Accordingly, the Al content is made 0.05 to 1.0%, preferably is made over 0.1 to 0.5%.

If N is present in the steel, AlN is formed. The atomic weight of N is 14, while the atomic weight of Al is 27. For example, if N is added at 0.01%, 27/14 times, that is, about 2 times the amount of N, that is, 0.02% of solute Al, is reduced. As a result, the focus of the present invention, that is, the effect of improvement of the tool lifetime, falls.

The solute Al has to be at least 0.05%, so if N is not 0%, it is necessary to add an amount of Al considering the amount of N.

That is, the amount of Al and the amount of N must satisfy $$[Al\ \%]-(27/14)\times[N\ \%]\geq 0.05\%$$

and preferably satisfy $$[Al\ \%]-(27/14)\times[N\ \%]>0.1\%$$

The steel for machine structure use of the present invention may have Ca added to it in addition to the above ingredients to improve the machinability.

Ca is a deoxidizing element. It lowers the melting point of the $Al_2O_3$ or other hard oxides to soften the steel and suppress tool wear. If the Ca content is less than 0.0001%, the effect of improvement of the machinability cannot be obtained. If the Ca content is over 0.02%, CaS forms in the steel and the machinability falls. Accordingly, when adding Ca, the content is made 0.0001 to 0.02%, preferably is made 0.0004 to 0.005%.

In the steel for machine structure use of the present invention, when forming carbonitrides and higher strength is required, in addition to the above ingredients, one or more types of elements of Ti: 0.0005 to 0.5%, Nb: 0.0005 to 0.5%, W: 0.0005 to 1.0%, and V: 0.0005 to 1.0% may be added.

Ti is an element which forms carbonitrides, suppresses growth of austenite grains, and contributes to strengthening. Ti is used as a grain size control element for preventing coarse grains for steel in which increased strength is required and steel in which low strain is required. Ti is also a deoxidizing element. By forming soft oxides, the machinability is improved.

If the Ti content is less than 0.0005%, the effect cannot be obtained. If the Ti content is over 0.5%, undissolved coarse carbonitrides causing hot cracking precipitate and the mechanical properties are impaired. Accordingly, when adding Ti, the content is made 0.0005 to 0.5%, preferably is made 0.01 to 0.3%.

Nb forms carbonitrides, strengthens the steel by secondary precipitation hardening, suppresses growth of austenite grains, and contributes to strengthening. Nb is used as a grain size control element for preventing coarse grains for steel in which increased strength is required and steel in which low strain is required.

If the Nb content is less than 0.0005%, the effect of increasing the strength cannot be obtained. If the Nb content is over 0.5%, undissolved coarse carbonitrides causing hot cracking precipitate and the mechanical properties are impaired. Accordingly, when adding Nb, the content is made 0.0005 to 0.5%, preferably is made 0.005 to 0.2%.

W can form carbonitrides and strengthen the steel by secondary precipitation hardening. If the W content is less than 0.0005%, the effect of increasing the strength cannot be obtained. If the W content is over 1.0%, undissolved coarse carbonitrides causing hot cracking precipitate and the mechanical properties are impaired. Accordingly, when adding W, the content is made 0.0005 to 1.0%, preferably 0.01 to 0.8%.

V can form carbonitrides and strengthen the steel by secondary precipitation hardening. V is suitably added to steel requiring an increase in strength. If the V content is less than 0.0005%, the effect of increasing the strength cannot be obtained. If the V content is over 1.0%, undissolved coarse carbonitrides causing hot cracking precipitate and the mechanical properties are impaired. Accordingly, when adding V, the content is made 0.0005 to 1.0%, preferably 0.01 to 0.8%

In the steel for machine structure use of the present invention, when a further higher strength is required, in addition to the above ingredients, Ta: 0.0001 to 0.2% and/or Hf: 0.0001 to 0.2% may also be added.

Ta strengthens the steel by secondary precipitation hardening, suppresses growth of austenite grains, and contributes to strengthening. Ta is used as a grain size control element for preventing coarse grains for steel in which increased strength is required and steel in which low strain is required.

If Ta content is less than 0.0001%, the effect of increasing the strength cannot be obtained. If the Ta content is over 0.2%, undissolved coarse precipitates causing hot cracking cause the mechanical properties to be impaired. Accordingly, when adding Ta, the content is made 0.0001 to 0.2%, preferably 0.001 to 0.1%.

Hf suppresses growth of austenite grains and contributes to strengthening. Hf is used as a grain size control element for preventing coarse grains for steel in which increased strength is required and steel in which low strain is required. If the Hf content is less than 0.0001%, the effect of increasing the strength cannot be obtained. If the Hf content is over 0.2%, undissolved coarse precipitates causing hot cracking cause the mechanical properties to be impaired. Accordingly, when adding Hf, the content is made 0.0001 to 0.2%, preferably is made 0.001 to 0.1%.

In the steel for machine structure use of the present invention, when controlling the mode of sulfides by adjustment by deoxidation, in addition to the above ingredients, one or more types of Mg: 0.0001 to 0.02%, Zr: 0.0001 to 0.02%, and Rem: 0.0001 to 0.02% may be added.

Mg is a deoxidizing element and forms oxides in the steel. If performing Al killing, the $Al_2O_3$ harmful to the machinability is reformed to MgO or $Al_2O_3$.MgO which is relatively soft and is finely dispersed. Further, the oxides easily form nuclei for MnS and cause fine dispersion of the MnS as an effect.

If the Mg content is less than 0.0001%, these effects cannot be obtained.

Mg forms complex sulfides with MnS to make the MnS spherical. If the Mg content is over 0.02%, it promotes the formation of solo MgS and causes the machinability to deteriorate. Accordingly, when adding Mg, the content is made 0.0001 to 0.02%, preferably 0.0003 to 0.0040%.

Zr is a deoxidizing element and forms oxides in the steel. The oxides are considered to be $ZrO_2$. These oxides form nuclei for precipitation of MnS, so have the effects of increasing the precipitation sites of MnS and causing uniform dispersion of MnS. Further, Zr forms a solid solution in MnS to form complex sulfides. It therefore also acts to lower the deformation ability and suppress elongation of the MnS shape at the time of rolling and hot forging. In this way, Zr is an element effective for reducing anisotropy.

If the Zr content is less than 0.0001%, these effects cannot be obtained. If the Zr content is over 0.02%, the yield becomes extremely poor. Further, $ZrO_2$ and ZrS and other hard compounds are formed in large amounts whereby the machinability, impact value, and the fatigue characteristics and other mechanical properties drop. Accordingly, when adding Zr, the content is made 0.0001 to 0.02%, preferably is made 0.0003 to 0.01%.

Rem (rare earth metal) is a deoxidizing element. It forms low melting point oxides and suppresses nozzle clogging at the time of casting. Rem forms a solid solution in or bonds with MnS to lower the deformation ability and suppress the elongation of the MnS shape at the time of rolling and hot forging. In this way, a Rem is an element effective for reducing the anisotropy.

If the Rem content is less than a total of 0.0001%, these effects cannot be obtained. If the Rem content is over 0.02%, sulfides of Rem are formed in large amounts and the machinability deteriorates. Accordingly, when adding an Rem, the content is made 0.0001 to 0.02%, preferably 0.0003 to 0.015%.

In the steel for machine structure use of the present invention, when improving the machinability, in addition to the above ingredients, it is also possible to add one or more types of elements of Sb: 0.0001 to 0.015%, Sn: 0.0005 to 2.0%, Zn: 0.0005 to 0.5%, B: 0.0001 to 0.015%, Te: 0.0003 to 0.2%, Se: 0.0003 to 0.2%, Bi: 0.001 to 0.5%, and Pb: 0.001 to 0.5%.

Sb suitably embrittles ferrite and improves the machinability. If the Sb content is 0.0001%, the effect cannot be obtained. If the Sb content is over 0.015%, the macroprecipitation of the Sb becomes excessive and the impact value greatly falls. Accordingly, when adding Sb, the content is made 0.0001 to 0.015%, preferably is made 0.0005 to 0.012%.

Sn embrittles the ferrite to extend the tool lifetime and improves the surface roughness. If the Sn content is less than 0.0005%, the effect cannot be obtained. If the Sn content is over 2.0%, the effect becomes saturated. Accordingly, when adding Sn, the content is made 0.0005 to 2.0%, preferably is made 0.002 to 1.0%.

Zn embrittles the ferrite to extend the tool lifetime and improves the surface roughness. If the Zn content is less than 0.0005%, the effect cannot be obtained. If over 0.5% of Zn is added, the effect becomes saturated. Accordingly, when adding Zn, the content is made 0.0005 to 0.5%, preferably is made 0.002 to 0.3%.

B has an effect on the grain boundary precipitation and quenchability when forming a solid solution and precipitates as BN and improves the machinability when precipitating. If the B content is less than 0.0001%, these effects cannot be obtained. If the B content is over 0.015%, the effect becomes saturated. When the BN precipitates too much, the mechanical properties of the steel are impaired. Accordingly, when adding B, the content is made 0.0001 to 0.015%, preferably is made 0.0005 to 0.01%.

Te improves the machinability. Further, it acts to form MnTe and, by copresence with MnS, causes a drop in the deformation ability of MnS and suppresses the elongation of the MnS shape. In this way, Te is an element effective for reducing the anisotropy.

If the Te content is less than 0.0003%, these effects cannot be obtained. If the Te content is over 0.2%, not only does the effect become saturated, but also the hot ductability falls and easily becomes a cause of flaws. Accordingly, when adding Te, the content is made 0.0003 to 0.2%, preferably is made 0.001 to 0.1%.

Se is an element improving the machinability. Further, it acts to form MnSe and, by copresence with MnS, causes a drop in the deformation ability of MnS and suppresses the elongation of the MnS shape. In this way, Se is an element effective for reducing the anisotropy.

If the Se content is less than 0.0003%, these effects cannot be obtained. If the Se content is over 0.2%, the effect becomes saturated. Accordingly, when adding Se, the content is made 0.0003 to 0.2%, preferably is made 0.001 to 0.1%.

Bi improves the machinability. If the Bi content is less than 0.001%, the effect cannot be obtained. If the Bi content is over 0.5%, not only does the effect of improving the machinability become saturated, but also the hot ductability falls and easily becomes a cause of flaws. Accordingly, when adding Bi, the content is made 0.001 to 0.5%, preferably is made 0.005 to 0.3%.

Pb improves the machinability. If the Pb content is less than 0.001%, the effect cannot be obtained. Even if over 0.5% of Pb is added, not only does the effect of improving the machinability become saturated, but also the hot ductability falls and easily becomes a cause of flaws. Accordingly, when adding Pb, the content is made 0.001 to 0.5%, preferably is made 0.005 to 0.3%.

In the steel for machine structure use of the present invention, when improving the quenchability, improving the temper-softening resistance, and imparting strength to the steel material, in addition to the above ingredients, it is possible to add Cr: 0.001 to 3.0% and/or Mo: 0.001 to 1.0%.

Cr improves the quenchability and imparts temper-softening resistance. Cr is added to steel requiring an increase in strength. If the Cr content is less than 0.001%, these effects cannot be obtained. If the Cr content is over 3.0%, Cr carbides are formed and the steel is embrittled. Accordingly, when adding Cr, the content is made 0.001 to 3.0%, preferably is made 0.01 to 2.0%.

No imparts the temper-softening resistance and improves the quenchability. Mo is added to steel requiring an increase in strength. If the Mo content is less than 0.001%, these effects cannot be obtained. If the Mo content is over 1.0%, the effect is saturated. Accordingly, when adding Mo, the content is made 0.001 to 1.0%, preferably is made 0.01 to 0.8%.

In the steel for machine structure use of the present invention, when strengthening the ferrite, in addition to the above ingredients, it is possible to add Ni: 0.001 to 5.0% and/or Cu: 0.001 to 5.0%.

Ni strengthens ferrite and improves the ductility. Ni is also effective for improving the quenchability and improving the corrosion resistance. If the Ni content is less than 0.001%, the effect cannot be obtained. If the Ni content is over 5.0%, the effect becomes saturated in the point of the mechanical properties and the machinability falls. Accordingly, when adding Ni, the content is made 0.001 to 5.0%, preferably is made 0.05 to 2.0%.

Cu strengthens the ferrite and improves the quenchability and corrosion resistance. If the Cu content is less than 0.001%, the effect cannot be obtained. If the Cu content is over 5.0%, the effect becomes saturated in the point of mechanical properties. Accordingly, when adding Cu, the content is made 0.001 to 5.0%, preferably is made 0.01 to 2.0%.

Cu in particular reduces the hot ductability and easily becomes a cause of flaws at the time of rolling, so is preferably added at the same time as the Ni.

To impart machinability to the steel for structural use of the present invention, in addition to the above ingredients, one or more types of elements of Li: 0.00001 to 0.005%, Na: 0.00001 to 0.005%, K: 0.00001 to 0.005%, Ba: 0.00001 to 0.005%, and Sr; 0.00001 to 0.005% can be added.

Li forms oxides in the steel and forms low melting point oxides to thereby suppress tool wear. If the Li content is less than 0.00001%, the effect cannot be obtained. If the Li content is over 0.005%, the effect is saturated and, further, melt loss of the refectories etc. are caused. Accordingly, when adding Li, the content is made 0.00001 to 0.005%, preferably is made 0.0001 to 0.0045%.

Na forms oxides in the steel and forms low melting point oxides to thereby suppress tool wear. If the Na content is less than 0.00001%, the effect cannot be obtained. If the Na content is over 0.005%, the effect is saturated and, further, melt loss of the refractories etc. are caused. Accordingly, when adding Na, the content is made 0.00001 to 0.005%, preferably is made 0.0001 to 0.0045%.

K forms oxides in the steel and forms low melting point oxides to thereby suppress tool wear. If the K content is less than 0.00001%, the effect cannot be obtained. If the K content is over 0.005%, the effect is saturated and, further, melt loss of the refractories etc. are caused. Accordingly, when adding K, the content is made 0.00001 to 0.005%, preferably is made 0.0001 to 0.0045%.

Ba forms oxides in the steel and forms low melting point oxides to thereby suppress tool wear. If the Ba content is less than 0.00001%, the effect cannot be obtained. If the Ba content is over 0.005%, the effect is saturated and, further, melt loss of the refectories etc. are caused. Accordingly, when adding Ba, the content is made 0.00001 to 0.005%, preferably is made 0.0001 to 0.0045%.

Sr forms oxides in the steel and forms low melting point oxides to thereby suppress tool wear. If the Sr content is less than 0.00001%, the effect cannot be obtained. If the Sr content is over 0.005%, the effect is saturated and, further, melt loss of the refectories etc. are caused. Accordingly, when adding Sr, the content is made 0.00001 to 0.005%, preferably is made 0.0001 to 0.0045%.

As explained above, according to the steel for machine structure use according to the present invention and machining method of the same, it is possible to obtain superior lubricating ability and tool lifetime by forming an $Al_2O_3$ coating by a chemical reaction on the tool surface during machining in a broad cutting speed range regardless of continuous machining, intermittent machining, or other systems.

EXAMPLES

Below, examples will be used to specifically explain the effects of the present invention.

Steels of the compositions shown in Tables 1 to 8 were smelted in a 150 kg vacuum smelting furnace, then hot forged under 1250° C. temperature conditions to produce 65 mm diameter rods. Next, these were hot rolled at 1300° C. for 2 hours, then air cooled, then annealed (heated at 900° C. for 1 hour, then air cooled), then test pieces for evaluation of tool lifetime were cut out and used for the tests.

For the cutting tools, five types made of TiAlN coated cemented alloy, high speed steel, cemented alloy, TiC coated high speed steel, and TiAlN coated high speed steel were used. On the surface layers of these tools, the metal oxide coatings shown in Tables 1 to 8 were formed.

The metal oxide coatings were metal oxides formed by PVD and $Fe_3O_4$ formed by homo treatment. The thickness of the Auger metal oxide coating was measured by Auger electron spectroscopy when less than 500 nm, while was measured by FE-SEM when 500 nm or more.

Tables 1 to 8 show the free energies of formation of oxides at 1300° C. of the metal oxides formed on the surface layers of tools.

The underlines in Tables 1 to 8 show that the requirements of the present invention are not satisfied.

TABLE 1

| | | Steel chemical composition (mass %) | | | | | | | | | |
|---|---|---|---|---|---|---|---|---|---|---|---|
| | No. | C | Si | Mn | P | S | Al | N | [Al %]-27/14[N %] | Other elements | Tool |
| Inv. ex. | 1 | 0.46 | 0.20 | 0.74 | 0.010 | 0.015 | 0.059 | 0.0040 | 0.051 | | TiAlN coated cemented alloy |
| Inv. ex. | 2 | 0.46 | 0.23 | 0.75 | 0.013 | 0.013 | 0.089 | 0.0045 | 0.080 | | TiAlN coated cemented alloy |
| Inv. ex. | 3 | 0.46 | 0.23 | 0.76 | 0.011 | 0.011 | 0.109 | 0.0040 | 0.101 | | TiAlN coated cemented alloy |
| Inv. ex. | 4 | 0.46 | 0.25 | 0.76 | 0.014 | 0.013 | 0.116 | 0.0054 | 0.106 | | TiAlN coated cemented alloy |
| Inv. ex. | 5 | 0.45 | 0.24 | 0.72 | 0.013 | 0.018 | 0.122 | 0.0060 | 0.110 | | TiAlN coated cemented alloy |
| Inv. ex. | 6 | 0.48 | 0.19 | 0.79 | 0.012 | 0.014 | 0.141 | 0.0047 | 0.132 | | TiAlN coated cemented alloy |
| Inv. ex. | 7 | 0.44 | 0.21 | 0.75 | 0.012 | 0.001 | 0.143 | 0.0043 | 0.135 | | TiAlN coated cemented alloy |
| Inv. ex. | 8 | 0.42 | 0.23 | 0.80 | 0.012 | 0.015 | 0.163 | 0.0046 | 0.154 | | TiAlN coated cemented alloy |
| Inv. ex. | 9 | 0.44 | 0.22 | 0.70 | 0.013 | 0.006 | 0.194 | 0.0121 | 0.171 | | TiAlN coated cemented alloy |
| Inv. ex. | 10 | 0.41 | 0.23 | 0.78 | 0.010 | 0.013 | 0.246 | 0.0050 | 0.236 | | TiAlN coated cemented alloy |

TABLE 1-continued

| | | | | | | | | | | | |
|---|---|---|---|---|---|---|---|---|---|---|---|
| Inv. ex. | 11 | 0.44 | 0.25 | 0.76 | 0.011 | 0.016 | 0.327 | 0.0110 | 0.306 | | TiAlN coated cemented alloy |
| Inv. ex. | 12 | 0.47 | 0.23 | 0.77 | 0.013 | 0.015 | 0.489 | 0.0071 | 0.475 | | TiAlN coated cemented alloy |
| Inv. ex. | 13 | 0.44 | 0.23 | 0.77 | 0.011 | 0.014 | 0.530 | 0.0050 | 0.520 | | TiAlN coated cemented alloy |
| Inv. ex. | 14 | 0.44 | 0.20 | 0.73 | 0.010 | 0.018 | 0.651 | 0.0100 | 0.632 | | TiAlN coated cemented alloy |
| Inv. ex. | 15 | 0.45 | 0.21 | 0.73 | 0.014 | 0.012 | 0.734 | 0.0046 | 0.725 | | TiAlN coated cemented alloy |
| Inv. ex. | 16 | 0.44 | 0.23 | 0.74 | 0.013 | 0.017 | 0.867 | 0.0071 | 0.853 | | TiAlN coated cemented alloy |
| Inv. ex. | 17 | 0.45 | 0.24 | 0.80 | 0.011 | 0.014 | 0.982 | 0.0050 | 0.972 | | TiAlN coated cemented alloy |
| Inv. ex. | 18 | 0.46 | 0.28 | 0.73 | 0.012 | 0.016 | 0.115 | 0.0048 | 0.106 | Ca: 0.0004 | TiAlN coated cemented alloy |
| Inv. ex. | 19 | 0.46 | 0.23 | 0.77 | 0.010 | 0.011 | 0.122 | 0.0102 | 0.102 | Ti: 0.25 | TiAlN coated cemented alloy |
| Inv. ex. | 20 | 0.46 | 0.25 | 0.76 | 0.013 | 0.011 | 0.152 | 0.0056 | 0.141 | Ti0.018, B: 0.0021 | TiAlN coated cemented alloy |
| Inv. ex. | 21 | 0.44 | 0.23 | 0.78 | 0.015 | 0.015 | 0.120 | 0.0056 | 0.109 | Nb: 0.009, Mg: 0.0020 | TiAlN coated cemented alloy |
| Inv. ex. | 22 | 0.41 | 0.25 | 0.73 | 0.015 | 0.014 | 0.153 | 0.0050 | 0.143 | Ta: 0.0001 | TiAlN coated cemented alloy |

| | No. | Metal oxide coating | Coating thickness (μm) | Standard free energy of formation of oxides at 1300° C. (kJ) | No. of holes: Water insoluble cutting fluid | No. of holes: Water soluble cutting fluid | No. of holes: Dry |
|---|---|---|---|---|---|---|---|
| Inv. ex. | 1 | $WO_2$ | 0.31 | −311 | 1707 | 1374 | 724 |
| Inv. ex. | 2 | $MoO_2$ | 0.24 | −314 | 1737 | 1397 | 737 |
| Inv. ex. | 3 | CoO | 0.27 | −248 | 1849 | 1486 | 783 |
| Inv. ex. | 4 | $SnO_2$ | 0.33 | −263 | 1862 | 1497 | 788 |
| Inv. ex. | 5 | ZnO | 0.38 | −296 | 1879 | 1510 | 795 |
| Inv. ex. | 6 | NiO | 0.21 | −204 | 1881 | 1512 | 796 |
| Inv. ex. | 7 | $TiO_2$ | 0.40 | −660 | 1847 | 1485 | 782 |
| Inv. ex. | 8 | $Cu_2O$ | 0.40 | −113 | 1890 | 1519 | 800 |
| Inv. ex. | 9 | VO | 0.26 | −597 | 1843 | 1482 | 781 |
| Inv. ex. | 10 | FeO | 0.21 | −342 | 1887 | 1516 | 799 |
| Inv. ex. | 11 | $Mn_3O_4$ | 0.15 | −421 | 1880 | 1511 | 796 |
| Inv. ex. | 12 | MnO | 0.11 | −537 | 1858 | 1493 | 787 |
| Inv. ex. | 13 | $VO_2$ | 0.22 | −463 | 1740 | 1400 | 738 |
| Inv. ex. | 14 | $V_2O_3$ | 0.25 | −557 | 1739 | 1399 | 738 |
| Inv. ex. | 15 | $WO_3$ | 0.19 | −300 | 1722 | 1386 | 731 |
| Inv. ex. | 16 | $Cr_2O_3$ | 0.18 | −480 | 1718 | 1382 | 729 |
| Inv. ex. | 17 | NiCrO | 0.20 | −480 | 1704 | 1371 | 723 |
| Inv. ex. | 18 | $Nb_2O_5$ | 0.30 | −492 | 1935 | 1554 | 819 |
| Inv. ex. | 19 | $NbO_2$ | 0.35 | −521 | 1865 | 1499 | 790 |
| Inv. ex. | 20 | NbO | 0.41 | −551 | 1869 | 1502 | 791 |
| Inv. ex. | 21 | $Ta_2O_5$ | 0.31 | −549 | 1867 | 1501 | 791 |
| Inv. ex. | 22 | $SiO_2$ | 0.24 | −633 | 1865 | 1499 | 790 |

TABLE 3

(Continuation of Table 1)

| | | Steel chemical composition (mass %) | | | | | | | | | |
|---|---|---|---|---|---|---|---|---|---|---|---|
| | No. | C | Si | Mn | P | S | Al | N | [Al %]-27/14[N %] | Other elements | Tool |
| Inv. ex. | 23 | 0.44 | 0.24 | 0.78 | 0.013 | 0.017 | 0.145 | 0.0052 | 0.135 | Nb: 0.03 | TiAlN coated cemented alloy |
| Inv. ex. | 24 | 0.47 | 0.25 | 0.74 | 0.013 | 0.016 | 0.173 | 0.0049 | 0.164 | W: 0.30 | TiAlN coated cemented alloy |
| Inv. ex. | 25 | 0.42 | 0.27 | 0.75 | 0.013 | 0.016 | 0.187 | 0.0089 | 0.170 | Ba: 0.0001 | TiAlN coated cemented alloy |
| Inv. ex. | 26 | 0.48 | 0.25 | 0.77 | 0.014 | 0.015 | 0.191 | 0.0048 | 0.182 | V: 0.47 | TiAlN coated cemented alloy |
| Inv. ex. | 27 | 0.42 | 0.26 | 0.73 | 0.016 | 0.016 | 0.163 | 0.0057 | 0.152 | V: 0.06, Ca: 0.0007 | TiAlN coated cemented alloy |
| Inv. ex. | 28 | 0.44 | 0.26 | 0.78 | 0.015 | 0.016 | 0.117 | 0.0040 | 0.109 | Ca: 0.0013 | TiAlN coated cemented alloy |
| Inv. ex. | 29 | 0.42 | 0.28 | 0.74 | 0.013 | 0.017 | 0.145 | 0.0051 | 0.135 | Hf: 0.0001 | TiAlN coated cemented alloy |
| Inv. ex. | 30 | 0.42 | 0.20 | 0.80 | 0.015 | 0.017 | 0.165 | 0.0050 | 0.155 | Mg: 0.0005 | TiAlN coated cemented alloy |
| Inv. ex. | 31 | 0.44 | 0.20 | 0.78 | 0.015 | 0.019 | 0.152 | 0.0050 | 0.142 | Ta: 0.06 | TiAlN coated cemented alloy |
| Inv. ex. | 32 | 0.46 | 0.23 | 0.72 | 0.017 | 0.019 | 0.195 | 0.0061 | 0.183 | Zr: 0.0021, Ca: 0.0014 | TiAlN coated cemented alloy |
| Inv. ex. | 33 | 0.42 | 0.24 | 0.72 | 0.012 | 0.018 | 0.301 | 0.0120 | 0.278 | Na: 0.00005 | TiAlN coated cemented alloy |
| Inv. ex. | 34 | 0.45 | 0.25 | 0.74 | 0.015 | 0.018 | 0.156 | 0.0054 | 0.146 | Ti: 0.07, Ca: 0.0012 | TiAlN coated cemented alloy |
| Inv. ex. | 35 | 0.48 | 0.21 | 0.72 | 0.011 | 0.017 | 0.308 | 0.0110 | 0.287 | Zr: 0.0046 | TiAlN coated cemented alloy |
| Inv. ex. | 36 | 0.47 | 0.27 | 0.74 | 0.016 | 0.019 | 0.210 | 0.0052 | 0.200 | Li: 0.0001 | TiAlN coated cemented alloy |
| Inv. ex. | 37 | 0.46 | 0.21 | 0.75 | 0.022 | 0.019 | 0.164 | 0.0044 | 0.156 | Sr: 0.0001 | TiAlN coated cemented alloy |
| Inv. ex. | 38 | 0.43 | 0.22 | 0.77 | 0.014 | 0.020 | 0.124 | 0.0054 | 0.114 | Rem: 0.0055 | TiAlN coated cemented alloy |
| Inv. ex. | 39 | 0.46 | 0.23 | 0.74 | 0.013 | 0.017 | 0.390 | 0.0045 | 0.381 | Sb: 0.0043 | TiAlN coated cemented alloy |
| Inv. ex. | 40 | 0.45 | 0.28 | 0.71 | 0.013 | 0.020 | 0.133 | 0.0057 | 0.122 | Hf: 0.06 | TiAlN coated cemented alloy |
| Inv. ex. | 41 | 0.48 | 0.21 | 0.76 | 0.011 | 0.019 | 0.410 | 0.0053 | 0.400 | Sn: 0.012 | TiAlN coated cemented alloy |
| Inv. ex. | 42 | 0.44 | 0.22 | 0.75 | 0.014 | 0.019 | 0.141 | 0.0043 | 0.133 | Nb: 0.11, Ca: 0.0015 | TiAlN coated cemented alloy |
| Inv. ex. | 43 | 0.44 | 0.21 | 0.76 | 0.014 | 0.016 | 0.449 | 0.0073 | 0.435 | Zn: 0.011 | TiAlN coated cemented alloy |
| Inv. ex. | 44 | 0.42 | 0.25 | 0.80 | 0.014 | 0.020 | 0.417 | 0.0069 | 0.404 | Te: 0.002 | TiAlN coated cemented alloy |

TABLE 3-continued (Continuation of Table 1)

| | No. | Metal oxide coating | Coating thickness (μm) | Standard free energy of formation of oxides at 1300° C. (kJ) | No. of holes: Water insoluble cutting fluid | No. of holes: Water soluble cutting fluid | No. of holes: Dry |
|---|---|---|---|---|---|---|---|
| Inv. ex. | 23 | $TiO_2$ | 0.22 | −660 | 1881 | 1512 | 796 |
| Inv. ex. | 24 | $Ti_3O_5$ | 0.20 | −709 | 1848 | 1486 | 783 |
| Inv. ex. | 25 | $Ti_2O_3$ | 0.19 | −733 | 1930 | 1551 | 817 |
| Inv. ex. | 26 | $WO_2$ | 0.33 | −311 | 1851 | 1488 | 784 |
| Inv. ex. | 27 | $MoO_2$ | 0.46 | −314 | 1938 | 1557 | 820 |
| Inv. ex. | 28 | FeO | 0.48 | −342 | 1945 | 1562 | 823 |
| Inv. ex. | 29 | $Mn_3O_4$ | 0.54 | −421 | 1872 | 1505 | 793 |
| Inv. ex. | 30 | MnO | 0.60 | −537 | 1879 | 1510 | 795 |
| Inv. ex. | 31 | $VO_2$ | 0.58 | −463 | 1870 | 1503 | 792 |
| Inv. ex. | 32 | $V_2O_3$ | 0.65 | −557 | 1941 | 1559 | 821 |
| Inv. ex. | 33 | VO | 0.71 | −597 | 1915 | 1539 | 810 |
| Inv. ex. | 34 | $Cr_2O_3$ | 0.78 | −480 | 1935 | 1554 | 819 |
| Inv. ex. | 35 | NiCrO | 0.52 | −480 | 1869 | 1502 | 791 |
| Inv. ex. | 36 | $Nb_2O_5$ | 0.79 | −492 | 1930 | 1551 | 817 |
| Inv. ex. | 37 | $NbO_2$ | 0.63 | −521 | 1931 | 1551 | 817 |
| Inv. ex. | 38 | NbO | 0.81 | −551 | 1878 | 1509 | 795 |
| Inv. ex. | 39 | $Ta_2O_5$ | 0.84 | −549 | 1937 | 1556 | 819 |
| Inv. ex. | 40 | $SiO_2$ | 0.88 | −633 | 1858 | 1493 | 787 |
| Inv. ex. | 41 | $TiO_2$ | 0.95 | −660 | 1924 | 1546 | 814 |
| Inv. ex. | 42 | $Ti_3O_5$ | 0.67 | −709 | 1940 | 1558 | 821 |
| Inv. ex. | 43 | $Ti_2O_3$ | 0.78 | −733 | 1925 | 1547 | 814 |
| Inv. ex. | 44 | $WO_2$ | 0.92 | −311 | 1927 | 1548 | 815 |

TABLE 3

(Continuation of Table 2)

| | No. | Steel chemical composition (mass %): C | Si | Mn | P | S | Al | N | [Al %] − 27/14[N %] | Other elements |
|---|---|---|---|---|---|---|---|---|---|---|
| Inv. ex. | 45 | 0.45 | 0.24 | 0.76 | 0.017 | 0.023 | 0.151 | 0.0043 | 0.143 | Cr: 1.0 |
| Inv. ex. | 46 | 0.45 | 0.25 | 0.70 | 0.015 | 0.024 | 0.289 | 0.0098 | 0.270 | Se: 0.0024 |
| Inv. ex. | 47 | 0.46 | 0.23 | 0.75 | 0.019 | 0.020 | 0.384 | 0.0045 | 0.375 | K: 0.00006 |
| Inv. ex. | 48 | 0.47 | 0.22 | 0.78 | 0.012 | 0.014 | 0.175 | 0.0048 | 0.166 | Bi: 0.08 |
| Inv. ex. | 49 | 0.48 | 0.25 | 0.80 | 0.013 | 0.016 | 0.188 | 0.0152 | 0.159 | Pb: 0.14 |
| Inv. ex. | 50 | 0.41 | 0.24 | 0.78 | 0.016 | 0.022 | 0.195 | 0.0052 | 0.185 | B: 0.0019 |
| Inv. ex. | 51 | 0.47 | 0.25 | 0.74 | 0.013 | 0.017 | 0.223 | 0.0161 | 0.192 | Mo: 0.28 |
| Inv. ex. | 52 | 0.45 | 0.23 | 0.77 | 0.010 | 0.015 | 0.173 | 0.0048 | 0.164 | Ni: 0.68 |
| Inv. ex. | 53 | 0.46 | 0.25 | 0.76 | 0.015 | 0.016 | 0.138 | 0.0152 | 0.109 | Cu: 0.11 |
| Inv. ex. | 54 | 0.45 | 0.24 | 0.76 | 0.014 | 0.016 | 0.132 | 0.0049 | 0.123 | Ni: 0.39, Cu: 0.18 |
| Inv. ex. | 55 | 0.43 | 0.22 | 0.70 | 0.014 | 0.020 | 0.201 | 0.0064 | 0.189 | Li: 0.00006 |
| Inv. ex. | 56 | 0.43 | 0.21 | 0.73 | 0.017 | 0.017 | 0.332 | 0.0059 | 0.321 | Na: 0.0001 |
| Inv. ex. | 57 | 0.45 | 0.23 | 0.80 | 0.019 | 0.019 | 0.190 | 0.0060 | 0.178 | K: 0.0001 |
| Inv. ex. | 58 | 0.46 | 0.24 | 0.79 | 0.014 | 0.020 | 0.184 | 0.0050 | 0.174 | Ba: 0.00008 |
| Inv. ex. | 59 | 0.46 | 0.25 | 0.74 | 0.015 | 0.016 | 0.208 | 0.0071 | 0.194 | Sr: 0.00007 |
| Inv. ex. | 60 | 0.45 | 0.23 | 0.79 | 0.014 | 0.014 | 0.150 | 0.0044 | 0.142 | Ca: 0.0035 |
| Inv. ex. | 61 | 0.47 | 0.29 | 0.72 | 0.016 | 0.013 | 0.143 | 0.0048 | 0.134 | B: 0.0019 |
| Inv. ex. | 62 | 0.39 | 0.25 | 0.65 | 0.014 | 0.021 | 0.152 | 0.0040 | 0.144 | Ca: 0.0021, Cr: 1.1 |
| Inv. ex. | 63 | 0.44 | 0.24 | 0.70 | 0.014 | 0.017 | 0.110 | 0.0043 | 0.102 | |
| Inv. ex. | 64 | 0.46 | 0.23 | 0.77 | 0.018 | 0.021 | 0.154 | 0.0064 | 0.142 | |
| Inv. ex. | 65 | 0.41 | 0.25 | 0.75 | 0.017 | 0.017 | 0.160 | 0.0050 | 0.150 | |
| Inv. ex. | 66 | 0.45 | 0.24 | 0.75 | 0.015 | 0.020 | 0.139 | 0.0040 | 0.131 | |

| | No. | Tool | Metal oxide coating | Coating thickness (μm) | Standard free energy of formation of oxides at 1300° C. (kJ) | No. of holes: Water insoluble cutting fluid | No. of holes: Water soluble cutting fluid | No. of holes: Dry |
|---|---|---|---|---|---|---|---|---|
| Inv. ex. | 45 | TiAlN coated cemented alloy | $MoO_2$ | 0.85 | −314 | 1876 | 1508 | 794 |
| Inv. ex. | 46 | TiAlN coated cemented alloy | FeO | 0.58 | −342 | 1930 | 1551 | 817 |
| Inv. ex. | 47 | TiAlN coated cemented alloy | $Mn_3O_4$ | 0.97 | −421 | 1917 | 1540 | 811 |
| Inv. ex. | 48 | TiAlN coated cemented alloy | MnO | 0.96 | −537 | 1952 | 1568 | 826 |

TABLE 3-continued (Continuation of Table 2)

| | | | | | | | | |
|---|---|---|---|---|---|---|---|---|
| Inv. ex. | 49 | TiAlN coated cemented alloy | $VO_2$ | 0.94 | −463 | 1975 | 1586 | 835 |
| Inv. ex. | 50 | TiAlN coated cemented alloy | $V_2O_3$ | 0.90 | −557 | 1857 | 1493 | 786 |
| Inv. ex. | 51 | TiAlN coated cemented alloy | VO | 0.84 | −597 | 1854 | 1490 | 785 |
| Inv. ex. | 52 | TiAlN coated cemented alloy | $Cr_2O_3$ | 0.77 | −480 | 1851 | 1488 | 784 |
| Inv. ex. | 53 | TiAlN coated cemented alloy | NiCrO | 0.41 | −480 | 1847 | 1485 | 782 |
| Inv. ex. | 54 | TiAlN coated cemented alloy | $Nb_2O_5$ | 0.52 | −492 | 1840 | 1479 | 779 |
| Inv. ex. | 55 | TiAlN coated cemented alloy | $NbO_2$ | 0.67 | −521 | 1911 | 1535 | 809 |
| Inv. ex. | 56 | TiAlN coated cemented alloy | NbO | 0.78 | −551 | 1934 | 1554 | 818 |
| Inv. ex. | 57 | TiAlN coated cemented alloy | $Ta_2O_5$ | 0.89 | −549 | 1933 | 1553 | 818 |
| Inv. ex. | 58 | TiAlN coated cemented alloy | $SiO_2$ | 0.91 | −633 | 1918 | 1541 | 812 |
| Inv. ex. | 59 | TiAlN coated cemented alloy | $TiO_2$ | 0.45 | −660 | 1917 | 1540 | 811 |
| Inv. ex. | 60 | TiAlN coated cemented alloy | $SiO_2$ | 0.21 | −633 | 1945 | 1562 | 823 |
| Inv. ex. | 61 | TiAlN coated cemented alloy | NiCrO | 0.21 | −480 | 1880 | 1511 | 796 |
| Inv. ex. | 62 | TiAlN coated cemented alloy | $TiO_2$ | 0.22 | −660 | 1940 | 1558 | 821 |
| Inv. ex. | 63 | TiAlN coated cemented alloy | $Ti_3O_5$ | 0.09 | −709 | 1871 | 1504 | 792 |
| Inv. ex. | 64 | TiAlN coated cemented alloy | $Ti_2O_3$ | 0.06 | −733 | 1874 | 1506 | 793 |
| Inv. ex. | 65 | TiAlN coated cemented alloy | $WO_2$ | 0.04 | −311 | 1703 | 1371 | 723 |
| Inv. ex. | 66 | TiAlN coated cemented alloy | $MoO_2$ | 0.02 | −314 | 1697 | 1366 | 720 |

TABLE 4

(Continuation of Table 3)

| | | Steel chemical composition (mass %) | | | | | | | | |
|---|---|---|---|---|---|---|---|---|---|---|
| | No. | C | Si | Mn | P | S | Al | N | [Al %] − 27/14[N %] | Other elements |
| Inv. ex. | 67 | 0.43 | 0.22 | 0.74 | 0.018 | 0.018 | 0.151 | 0.0046 | 0.142 | |
| Inv. ex. | 68 | 0.44 | 0.23 | 0.76 | 0.017 | 0.020 | 0.154 | 0.0048 | 0.145 | |
| Inv. ex. | 69 | 0.47 | 0.28 | 0.81 | 0.015 | 0.017 | 0.139 | 0.0043 | 0.131 | |
| Inv. ex. | 70 | 0.46 | 0.27 | 0.75 | 0.016 | 0.017 | 0.153 | 0.0060 | 0.141 | |
| Inv. ex. | 71 | 0.43 | 0.25 | 0.73 | 0.015 | 0.018 | 0.158 | 0.0050 | 0.148 | |
| Inv. ex. | 72 | 0.30 | 2.01 | 0.64 | 0.017 | 0.027 | 0.160 | 0.0050 | 0.150 | |
| Inv. ex. | 73 | 0.36 | 1.01 | 0.75 | 0.015 | 0.020 | 0.141 | 0.0050 | 0.131 | |
| Inv. ex. | 74 | 0.34 | 0.22 | 1.50 | 0.017 | 0.011 | 0.158 | 0.0047 | 0.149 | |
| Inv. ex. | 75 | 0.20 | 0.10 | 2.13 | 0.015 | 0.025 | 0.139 | 0.0043 | 0.131 | |
| Inv. ex. | 76 | 0.53 | 0.22 | 0.60 | 0.018 | 0.024 | 0.156 | 0.0055 | 0.145 | |
| Inv. ex. | 77 | 0.54 | 0.61 | 0.38 | 0.017 | 0.027 | 0.135 | 0.0049 | 0.126 | |
| Inv. ex. | 78 | 0.60 | 0.09 | 0.43 | 0.015 | 0.027 | 0.129 | 0.0050 | 0.119 | |
| Comp. ex. | 79 | 0.48 | 0.22 | 0.71 | 0.012 | 0.021 | 0.048 | 0.0048 | 0.039 | |
| Comp. ex. | 80 | 0.48 | 0.24 | 0.70 | 0.010 | 0.017 | 0.040 | 0.0044 | 0.032 | |
| Comp. ex. | 81 | 0.45 | 0.20 | 0.78 | 0.015 | 0.022 | 0.030 | 0.0050 | 0.020 | |
| Comp. ex. | 82 | 0.43 | 0.22 | 0.76 | 0.014 | 0.024 | 1.090 | 0.0052 | 1.080 | |
| Comp. ex. | 83 | 0.42 | 0.23 | 0.76 | 0.015 | 0.028 | 1.340 | 0.0051 | 1.330 | |
| Comp. ex. | 84 | 0.44 | 0.25 | 0.73 | 0.014 | 0.020 | 0.070 | 0.0150 | 0.041 | |
| Comp. ex. | 85 | 0.43 | 0.23 | 0.75 | 0.016 | 0.019 | 0.136 | 0.0056 | 0.125 | |
| Comp. ex. | 86 | 0.45 | 0.25 | 0.79 | 0.014 | 0.011 | 0.152 | 0.0061 | 0.140 | |
| Comp. ex. | 87 | 0.42 | 0.21 | 0.74 | 0.018 | 0.015 | 0.175 | 0.0056 | 0.164 | |
| Comp. ex. | 88 | 0.43 | 0.26 | 0.78 | 0.014 | 0.019 | 0.203 | 0.0053 | 0.193 | |

| | | | | | Standard free energy of formation | No. of holes | | |
|---|---|---|---|---|---|---|---|---|
| | No. | Tool | Metal oxide coating | Coating thickness (μm) | of oxides at 1300° C. (kJ) | Water insoluble cutting fluid | Water soluble cutting fluid | Dry |
| Inv. ex. | 67 | TiAlN coated cemented alloy | FeO | 1.21 | −342 | 1698 | 1367 | 721 |
| Inv. ex. | 68 | TiAlN coated cemented alloy | $Mn_3O_4$ | 2.77 | −421 | 1695 | 1364 | 720 |
| Inv. ex. | 69 | TiAlN coated cemented alloy | MnO | 3.13 | −537 | 1660 | 1336 | 705 |
| Inv. ex. | 70 | TiAlN coated cemented alloy | $VO_2$ | 4.82 | −463 | 1652 | 1330 | 702 |
| Inv. ex. | 71 | TiAlN coated cemented alloy | $V_2C_3$ | 5.11 | −557 | 1601 | 1290 | 681 |
| Inv. ex. | 72 | TiAlN coated cemented alloy | VO | 0.21 | −597 | 1863 | 1497 | 789 |
| Inv. ex. | 73 | TiAlN coated cemented alloy | $Cr_2O_3$ | 0.24 | −480 | 1880 | 1511 | 796 |
| Inv. ex. | 74 | TiAlN coated cemented alloy | NiCrO | 0.18 | −480 | 1872 | 1505 | 793 |
| Inv. ex. | 75 | TiAlN coated cemented alloy | $Nb_2O_5$ | 0.22 | −492 | 1867 | 1501 | 791 |
| Inv. ex. | 76 | TiAlN coated cemented alloy | $NbO_2$ | 0.30 | −521 | 1873 | 1505 | 793 |
| Inv. ex. | 77 | TiAlN coated cemented alloy | NbO | 0.24 | −551 | 1872 | 1505 | 793 |
| Inv. ex. | 78 | TiAlN coated cemented alloy | $Ta_2O_5$ | 0.26 | −549 | 1864 | 1498 | 789 |
| Comp. ex. | 79 | TiAlN coated cemented alloy | MnO | 0.32 | −537 | 650 | 541 | 305 |
| Comp. ex. | 80 | TiAlN coated cemented alloy | VO | 0.28 | −597 | 636 | 530 | 299 |
| Comp. ex. | 81 | TiAlN coated cemented alloy | NiCrO | 0.37 | −480 | 629 | 524 | 296 |

TABLE 4-continued (Continuation of Table 3)

| | | | | | | | | |
|---|---|---|---|---|---|---|---|---|
| Comp. ex. | 82 | TiAlN coated cemented alloy | NbO | 0.31 | −551 | 659 | 548 | 309 |
| Comp. ex. | 83 | TiAlN coated cemented alloy | $SiO_2$ | 0.21 | −633 | 653 | 543 | 306 |
| Comp. ex. | 84 | TiAlN coated cemented alloy | $Ti_3O_5$ | 0.19 | −709 | 658 | 548 | 309 |
| Comp. ex. | 85 | TiAlN coated cemented alloy | $ZrO_2$ | 0.31 | −803 | 634 | 528 | 298 |
| Comp. ex. | 86 | TiAlN coated cemented alloy | MgO | 0.22 | −816 | 623 | 519 | 293 |
| Comp. ex. | 87 | TiAlN coated cemented alloy | CaO | 0.28 | −943 | 627 | 522 | 295 |
| Comp. ex. | 88 | TiAlN coated cemented alloy | No coating | — | — | 617 | 514 | 290 |

TABLE 5

| | | Steel chemical composition (mass %) | | | | | | | | |
|---|---|---|---|---|---|---|---|---|---|---|
| | No. | C | Si | Mn | P | S | Al | N | [Al %] − 27/14[N %] | Other elements |
| Inv. ex. | 89 | 0.46 | 0.25 | 0.75 | 0.014 | 0.058 | 0.143 | 0.0045 | 0.134 | |
| Inv. ex. | 90 | 0.44 | 0.23 | 0.74 | 0.015 | 0.060 | 0.210 | 0.0123 | 0.186 | |
| Inv. ex. | 91 | 0.42 | 0.25 | 0.73 | 0.016 | 0.092 | 0.136 | 0.0047 | 0.127 | |
| Inv. ex. | 92 | 0.47 | 0.26 | 0.77 | 0.016 | 0.052 | 0.113 | 0.0051 | 0.103 | |
| Inv. ex. | 93 | 0.45 | 0.27 | 0.76 | 0.013 | 0.055 | 0.222 | 0.0049 | 0.213 | |
| Inv. ex. | 94 | 0.47 | 0.24 | 0.72 | 0.015 | 0.051 | 0.467 | 0.0153 | 0.437 | |
| Inv. ex. | 95 | 0.44 | 0.26 | 0.77 | 0.014 | 0.054 | 0.116 | 0.0055 | 0.105 | |
| Inv. ex. | 96 | 0.43 | 0.24 | 0.75 | 0.014 | 0.050 | 0.173 | 0.0047 | 0.164 | |
| Inv. ex. | 97 | 0.44 | 0.28 | 0.78 | 0.015 | 0.054 | 0.133 | 0.0044 | 0.125 | |
| Comp. ex. | 98 | 0.45 | 0.22 | 0.77 | 0.015 | 0.052 | 0.039 | 0.0045 | 0.030 | |
| Comp. ex. | 99 | 0.47 | 0.24 | 0.75 | 0.014 | 0.056 | 1.150 | 0.0053 | 1.140 | |
| Comp. ex. | 100 | 0.45 | 0.27 | 0.74 | 0.016 | 0.060 | 0.077 | 0.0151 | 0.048 | |
| Comp. ex. | 101 | 0.43 | 0.24 | 0.73 | 0.018 | 0.060 | 0.231 | 0.0055 | 0.220 | |
| Comp. ex. | 102 | 0.44 | 0.26 | 0.77 | 0.015 | 0.054 | 0.143 | 0.0053 | 0.133 | |

| | | | | | Standard free | VL1000 (m/min) | |
|---|---|---|---|---|---|---|---|
| | No. | Tool | Metal oxide coating | Coating thickness (μm) | energy of formation of oxides at 1300° C. (kJ) | Water insoluble cutting fluid | Dry |
| Inv. ex. | 89 | High speed steel | ZnO | 2.2 | −296 | 124 | 72 |
| Inv. ex. | 90 | High speed steel | $WO_3$ | 2.0 | −300 | 127 | 74 |
| Inv. ex. | 91 | High speed steel | $Nb_2O_5$ | 1.9 | −492 | 132 | 77 |
| Inv. ex. | 92 | High speed steel | $V_2O_3$ | 2.3 | −557 | 120 | 70 |
| Inv. ex. | 93 | High speed steel | NbO | 2.1 | −551 | 122 | 71 |
| Inv. ex. | 94 | High speed steel | $Ta_2O_5$ | 2.4 | −549 | 119 | 69 |
| Inv. ex. | 95 | High speed steel | $SiO_2$ | 2.1 | −633 | 125 | 73 |
| Inv. ex. | 96 | High speed steel | $Ti_3O_5$ | 2.4 | −709 | 130 | 75 |
| Inv. ex. | 97 | High speed steel | $Fe_3O_4$ | 2.3 | −308 | 106 | 62 |
| Comp. ex. | 98 | High speed steel | $V_2O_3$ | 2.0 | −557 | 57 | 25 |
| Comp. ex. | 99 | High speed steel | $Ta_2O_5$ | 2.1 | −549 | 51 | 22 |
| Comp. ex. | 100 | High speed steel | $Ti_3O_5$ | 2.4 | −709 | 53 | 23 |
| Comp. ex. | 101 | High speed steel | MgO | 2.5 | −816 | 59 | 26 |
| Comp. ex. | 102 | High speed steel | No coating | — | — | 56 | 24 |

TABLE 6

| | | Steel chemical composition (mass %) | | | | | | | | |
|---|---|---|---|---|---|---|---|---|---|---|
| | No. | C | Si | Mn | P | S | Al | N | [Al %] − 27/14[N %] | Other elements |
| Inv. ex. | 103 | 0.58 | 0.25 | 1.01 | 0.014 | 0.022 | 0.134 | 0.0054 | 0.124 | |
| Inv. ex. | 104 | 0.56 | 0.89 | 0.65 | 0.013 | 0.018 | 0.164 | 0.0060 | 0.152 | |
| Inv. ex. | 105 | 0.61 | 0.27 | 0.79 | 0.012 | 0.019 | 0.305 | 0.0047 | 0.296 | |
| Inv. ex. | 106 | 0.78 | 0.15 | 0.35 | 0.011 | 0.018 | 0.173 | 0.0110 | 0.152 | |
| Inv. ex. | 107 | 0.65 | 0.23 | 0.80 | 0.012 | 0.021 | 0.129 | 0.0046 | 0.120 | |
| Inv. ex. | 108 | 0.67 | 0.28 | 0.78 | 0.013 | 0.017 | 0.114 | 0.0039 | 0.106 | |
| Inv. ex. | 109 | 0.72 | 0.23 | 0.51 | 0.010 | 0.017 | 0.153 | 0.0050 | 0.143 | |
| Inv. ex. | 110 | 0.64 | 0.63 | 0.39 | 0.011 | 0.023 | 0.201 | 0.0040 | 0.193 | |
| Inv. ex. | 111 | 0.45 | 2.16 | 0.56 | 0.013 | 0.022 | 0.231 | 0.0148 | 0.202 | |
| Inv. ex. | 112 | 0.52 | 1.40 | 0.46 | 0.011 | 0.006 | 0.194 | 0.0050 | 0.184 | |
| Inv. ex. | 113 | 0.41 | 0.05 | 2.09 | 0.010 | 0.020 | 0.181 | 0.0100 | 0.162 | |
| Inv. ex. | 114 | 0.49 | 0.25 | 1.45 | 0.014 | 0.023 | 0.481 | 0.0046 | 0.472 | |
| Inv. ex. | 115 | 0.92 | 0.05 | 0.33 | 0.015 | 0.019 | 0.153 | 0.0042 | 0.145 | |
| Inv. ex. | 116 | 1.10 | 0.03 | 0.31 | 0.017 | 0.020 | 0.149 | 0.0045 | 0.140 | |

TABLE 6-continued

| | | | | | | | | | |
|---|---|---|---|---|---|---|---|---|---|
| Comp. ex. | 117 | 0.64 | 0.25 | 0.71 | 0.014 | 0.021 | 0.045 | 0.0046 | 0.036 |
| Comp. ex. | 118 | 0.58 | 0.30 | 1.03 | 0.015 | 0.023 | 1.100 | 0.0043 | 1.092 |
| Comp. ex. | 119 | 0.44 | 0.05 | 2.01 | 0.017 | 0.018 | 0.076 | 0.0151 | 0.047 |
| Comp. ex. | 120 | 0.45 | 2.02 | 0.61 | 0.019 | 0.019 | 0.145 | 0.0050 | 0.135 |
| Comp. ex. | 121 | 0.70 | 0.22 | 0.58 | 0.012 | 0.020 | 0.186 | 0.0057 | 0.175 |

| | No. | Tool | Metal oxide coating | Coating thickness (μm) | Standard free energy of formation of oxides at 1300° C. (kJ) | VB_max (μm) Water insoluble cutting fluid | VB_max (μm) Water soluble cutting fluid | VB_max (μm) Dry |
|---|---|---|---|---|---|---|---|---|
| Inv. ex. | 103 | Cemented alloy | $Cu_2O$ | 0.97 | −113 | 68 | 95 | 133 |
| Inv. ex. | 104 | Cemented alloy | CoO | 0.95 | −248 | 66 | 93 | 129 |
| Inv. ex. | 105 | Cemented alloy | ZnO | 0.97 | −296 | 63 | 89 | 124 |
| Inv. ex. | 106 | Cemented alloy | $WO_2$ | 0.91 | −311 | 76 | 104 | 148 |
| Inv. ex. | 107 | Cemented alloy | FeO | 0.98 | −342 | 71 | 98 | 139 |
| Inv. ex. | 108 | Cemented alloy | MnO | 0.97 | −537 | 74 | 102 | 144 |
| Inv. ex. | 109 | Cemented alloy | $V_2O_3$ | 0.89 | −557 | 73 | 101 | 143 |
| Inv. ex. | 110 | Cemented alloy | $Cr_2O_3$ | 0.95 | −480 | 64 | 90 | 126 |
| Inv. ex. | 111 | Cemented alloy | $Nb_2O_5$ | 0.86 | −492 | 69 | 96 | 135 |
| Inv. ex. | 112 | Cemented alloy | NbO | 0.90 | −551 | 65 | 93 | 128 |
| Inv. ex. | 113 | Cemented alloy | $SiO_2$ | 0.93 | −633 | 70 | 97 | 137 |
| Inv. ex. | 114 | Cemented alloy | $Ti_3O_5$ | 0.97 | −709 | 67 | 94 | 131 |
| Inv. ex. | 115 | Cemented alloy | VO | 0.93 | −597 | 85 | 121 | 179 |
| Inv. ex. | 116 | Cemented alloy | $TiO_2$ | 0.97 | −660 | 87 | 123 | 190 |
| Comp. ex. | 117 | Cemented alloy | $WO_2$ | 0.96 | −311 | 192 | 220 | 397 |
| Comp. ex. | 118 | Cemented alloy | FeO | 0.93 | −342 | 195 | 223 | 403 |
| Comp. ex. | 119 | Cemented alloy | MnO | 0.97 | −537 | 193 | 221 | 399 |
| Comp. ex. | 120 | Cemented alloy | $ZrO_2$ | 0.96 | −803 | 199 | 228 | 411 |
| Comp. ex. | 121 | Cemented alloy | No coating | — | — | 198 | 227 | 409 |

TABLE 7

| | No. | Steel chemical ingredients (mass %) C | Si | Mn | P | S | Al | N | [Al %] − 27/14[N %] | Other elements |
|---|---|---|---|---|---|---|---|---|---|---|
| Inv. ex. | 122 | 0.10 | 0.02 | 0.34 | 0.006 | 0.030 | 0.118 | 0.0048 | 0.109 | |
| Inv. ex. | 123 | 0.08 | 0.03 | 0.38 | 0.008 | 0.034 | 0.113 | 0.0041 | 0.105 | |
| Inv. ex. | 124 | 0.15 | 0.01 | 0.36 | 0.009 | 0.029 | 0.138 | 0.0056 | 0.127 | |
| Inv. ex. | 125 | 0.14 | 0.02 | 0.37 | 0.002 | 0.028 | 0.146 | 0.0074 | 0.132 | |
| Inv. ex. | 126 | 0.19 | 0.01 | 0.32 | 0.007 | 0.025 | 0.117 | 0.0065 | 0.104 | |
| Inv. ex. | 127 | 0.23 | 0.01 | 0.28 | 0.007 | 0.039 | 0.132 | 0.0049 | 0.123 | |
| Inv. ex. | 128 | 0.14 | 0.03 | 0.39 | 0.006 | 0.041 | 0.175 | 0.0100 | 0.156 | |
| Inv. ex. | 129 | 0.11 | 0.02 | 0.34 | 0.007 | 0.047 | 0.223 | 0.0089 | 0.206 | |
| Inv. ex. | 130 | 0.09 | 0.03 | 0.35 | 0.006 | 0.033 | 0.120 | 0.0070 | 0.107 | |
| Inv. ex. | 131 | 0.11 | 0.03 | 0.40 | 0.007 | 0.031 | 0.468 | 0.0056 | 0.457 | |
| Inv. ex. | 132 | 0.07 | 0.04 | 0.41 | 0.008 | 0.037 | 0.109 | 0.0043 | 0.101 | |
| Inv. ex. | 133 | 0.14 | 0.01 | 0.34 | 0.007 | 0.031 | 0.136 | 0.0039 | 0.128 | |
| Comp. ex. | 134 | 0.10 | 0.03 | 0.37 | 0.008 | 0.035 | 0.042 | 0.0045 | 0.033 | |
| Comp. ex. | 135 | 0.08 | 0.04 | 0.38 | 0.009 | 0.030 | 1.200 | 0.0050 | 1.190 | |
| Comp. ex. | 136 | 0.15 | 0.02 | 0.35 | 0.006 | 0.037 | 0.080 | 0.0164 | 0.048 | |
| Comp. ex. | 137 | 0.21 | 0.02 | 0.33 | 0.009 | 0.045 | 0.134 | 0.0045 | 0.125 | |
| Comp. ex. | 138 | 0.13 | 0.03 | 0.31 | 0.007 | 0.041 | 0.176 | 0.0058 | 0.165 | |

| | No. | Tool | Metal oxide coating | Coating thickness (μm) | Standard free energy of formation at 1300° C. (kJ) | VB_max (μm) Water insoluble cutting fluid |
|---|---|---|---|---|---|---|
| Inv. ex. | 122 | TiC coated high speed steel | NiO | 0.31 | −204 | 74 |
| Inv. ex. | 123 | TiC coated high speed steel | $SnO_2$ | 0.20 | −263 | 72 |
| Inv. ex. | 124 | TiC coated high speed steel | $WO_3$ | 0.17 | −300 | 83 |
| Inv. ex. | 125 | TiC coated high speed steel | $MoO_2$ | 0.23 | −314 | 82 |
| Inv. ex. | 126 | TiC coated high speed steel | $Mn_3O_4$ | 0.19 | −421 | 87 |
| Inv. ex. | 127 | TiC coated high speed steel | $VO_2$ | 0.39 | −463 | 89 |
| Inv. ex. | 128 | TiC coated high speed steel | VO | 0.23 | −597 | 84 |
| Inv. ex. | 129 | TiC coated high speed steel | NiCrO | 0.22 | −480 | 76 |
| Inv. ex. | 130 | TiC coated high speed steel | $NbO_2$ | 0.17 | −521 | 73 |
| Inv. ex. | 131 | TiC coated high speed steel | $Ta_2O_5$ | 0.34 | −549 | 78 |
| Inv. ex. | 132 | TiC coated high speed steel | $TiO_2$ | 0.17 | −660 | 71 |
| Inv. ex. | 133 | TiC coated high speed steel | $Ti_2O_3$ | 0.37 | −733 | 81 |
| Comp. ex. | 134 | TiC coated high speed steel | $MoO_2$ | 0.32 | −314 | 174 |
| Comp. ex. | 135 | TiC coated high speed steel | VO | 0.31 | −597 | 170 |
| Comp. ex. | 136 | TiC coated high speed steel | $TiO_2$ | 0.19 | −660 | 181 |

TABLE 7-continued

| | | | | | | |
|---|---|---|---|---|---|---|
| Comp. ex. | 137 | TiC coated high speed steel | MgO | 0.31 | −816 | 185 |
| Comp. ex. | 138 | TiC coated high speed steel | No coating | — | — | 177 |

TABLE 8

| | | Steel chemical ingredients (mass %) | | | | | | | | |
|---|---|---|---|---|---|---|---|---|---|---|
| | No. | C | Si | Mn | P | S | Al | N | [Al %] − 27/14[N %] | Other elements |
| Inv. ex. | 139 | 0.21 | 0.20 | 0.74 | 0.010 | 0.015 | 0.120 | 0.0040 | 0.112 | Cr: 1.0 |
| Inv. ex. | 140 | 0.25 | 0.23 | 0.75 | 0.013 | 0.013 | 0.126 | 0.0101 | 0.107 | Cr: 1.1 |
| Inv. ex. | 141 | 0.22 | 0.23 | 0.76 | 0.011 | 0.013 | 0.315 | 0.0154 | 0.285 | Cr: 1.1, Mo: 0.15 |
| Inv. ex. | 142 | 0.15 | 0.32 | 0.93 | 0.015 | 0.016 | 0.458 | 0.0112 | 0.436 | Cr: 1.2, Mo: 0.2 |
| Inv. ex. | 143 | 0.19 | 0.25 | 0.76 | 0.014 | 0.013 | 0.116 | 0.0068 | 0.103 | Cr: 1.2 |
| Inv. ex. | 144 | 0.20 | 0.24 | 0.72 | 0.013 | 0.014 | 0.145 | 0.0108 | 0.124 | Cr: 1.0, Ca: 0.0007 |
| Inv. ex. | 145 | 0.21 | 0.24 | 0.75 | 0.013 | 0.015 | 0.166 | 0.0115 | 0.144 | Cr: 1.0, Nb: 0.03 |
| Inv. ex. | 146 | 0.22 | 0.25 | 0.73 | 0.012 | 0.012 | 0.202 | 0.0055 | 0.191 | Cr: 1.0, Mo: 0.14 |
| Inv. ex. | 147 | 0.35 | 0.16 | 0.57 | 0.014 | 0.019 | 0.253 | 0.0101 | 0.234 | Cr: 0.9 |
| Inv. ex. | 148 | 0.21 | 0.25 | 0.72 | 0.014 | 0.015 | 0.152 | 0.0121 | 0.129 | Cr: 1.2 |
| Inv. ex. | 149 | 0.22 | 0.25 | 0.75 | 0.015 | 0.016 | 0.123 | 0.0115 | 0.101 | Cr: 1.1, Mo: 0.15 |
| Inv. ex. | 150 | 0.21 | 0.27 | 0.71 | 0.013 | 0.015 | 0.103 | 0.0080 | 0.088 | Cr: 1.0 |
| Comp. ex. | 151 | 0.20 | 0.22 | 0.76 | 0.014 | 0.018 | 0.040 | 0.0051 | 0.030 | Cr: 1.0 |
| Comp. ex. | 152 | 0.25 | 0.22 | 0.76 | 0.015 | 0.013 | 1.020 | 0.0120 | 0.997 | Cr: 1.0, Mo: 0.13 |
| Comp. ex. | 153 | 0.20 | 0.25 | 0.76 | 0.014 | 0.015 | 0.068 | 0.0151 | 0.039 | Cr: 1.0 |
| Comp. ex. | 154 | 0.20 | 0.23 | 0.77 | 0.016 | 0.014 | 0.140 | 0.0093 | 0.122 | Cr: 1.1 |
| Comp. ex. | 155 | 0.24 | 0.26 | 0.78 | 0.014 | 0.014 | 0.124 | 0.0110 | 0.103 | Cr: 1.0 |

| | | | | | Standard | VB_max (μm) | |
|---|---|---|---|---|---|---|---|
| | No. | Tool | Metal oxide coating | Coating thickness (μm) | free energy of formation at 1300° C. (kJ/mol) | Water insoluble cutting fluid | Dry |
| Inv. ex. | 139 | TiAlN coated high speed steel | $Cu_2O$ | 0.31 | −113 | 25 | 63 |
| Inv. ex. | 140 | TiAlN coated high speed steel | CoO | 0.22 | −248 | 31 | 71 |
| Inv. ex. | 141 | TiAlN coated high speed steel | ZnO | 0.32 | −296 | 30 | 70 |
| Inv. ex. | 142 | TiAlN coated high speed steel | $WO_2$ | 0.27 | −311 | 23 | 59 |
| Inv. ex. | 143 | TiAlN coated high speed steel | FeO | 0.36 | −342 | 24 | 60 |
| Inv. ex. | 144 | TiAlN coated high speed steel | MnO | 0.28 | −537 | 17 | 49 |
| Inv. ex. | 145 | TiAlN coated high speed steel | $V_2O_3$ | 0.24 | −557 | 27 | 65 |
| Inv. ex. | 146 | TiAlN coated high speed steel | $Cr_2O_3$ | 0.33 | −480 | 28 | 57 |
| Inv. ex. | 147 | TiAlN coated high speed steel | $Nb_2O_5$ | 0.35 | −492 | 33 | 74 |
| Inv. ex. | 148 | TiAlN coated high speed steel | NbO | 0.18 | −551 | 26 | 64 |
| Inv. ex. | 149 | TiAlN coated high speed steel | $SiO_2$ | 0.25 | −633 | 29 | 68 |
| Inv. ex. | 150 | TiAlN coated high speed steel | $Ti_3O_3$ | 0.20 | −709 | 45 | 88 |
| Comp. ex. | 151 | TiAlN coated high speed steel | MnO | 0.22 | −537 | 98 | 156 |
| Comp. ex. | 152 | TiAlN coated high speed steel | $V_2O_3$ | 0.34 | −557 | 93 | 148 |
| Comp. ex. | 153 | TiAlN coated high speed steel | $Cr_2O_3$ | 0.41 | −480 | 99 | 157 |
| Comp. ex. | 154 | TiAlN coated high speed steel | MgO | 0.18 | −816 | 90 | 143 |
| Comp. ex. | 155 | TiAlN coated high speed steel | No coating | — | — | 93 | 148 |

These steels and tools were used for the following five types of tests.

Under the conditions shown in Table 9, drill boring tests were run. The number of holes until the drills broke was used as an evaluation index to evaluate the tool lifetime when machining the steel materials of the invention examples and comparative examples. The tests were run using water-insoluble cutting fluids and water-soluble cutting fluids and dry (air blow).

TABLE 9

| | | |
|---|---|---|
| Machining conditions | Speed | 150 m/min |
| | Feed | 0.25 mm/rev |
| Drill | Drill size | Φ3 mm |
| | Material | TiAlN coated cemented alloy |
| | Projection | 45 mm |
| Others | Hole depth | 9 mm |
| | Tool lifetime | Until breakage |

Under the conditions shown in Table 10, drill boring tests were run. The maximum cutting speed VL1000 enabling machining up to a cumulative hole depth of 1000 mm was used as an evaluation index to evaluate the tool lifetime when machining the steel materials of the invention examples and comparative examples. The tests were run using water-insoluble cutting fluids and dry (air blow).

TABLE 10

| | | |
|---|---|---|
| Machining conditions | Speed | 10 to 140 m/min |
| | Feed | 0.1 mm/rev |
| Drill | Drill size | Φ3 mm |
| | Material | High speed steel |
| | Projection | 45 mm |
| Others | Hole depth | 9 mm |
| | Tool lifetime | Until breakage |

Under the conditions shown in Table 11, longitudinal turning tests were run. The maximum wear VB_max of the relief surface after machining for 10 minutes was used as an evaluation index to evaluate the tool lifetime when machining the steel materials of the invention examples and comparative examples. The tests were run using water-insoluble cutting fluids and water-soluble cutting fluids and dry (air blow).

TABLE 11

| | | |
|---|---|---|
| Machining conditions | Speed | 250 m/min |
| | Feed | 0.3 mm/rev |
| | Depth of cut | 1.5 mm |
| | Cutting time | 10 min |
| Tool | Material | Cemented alloy |
| | Shape | SNGA120408 |

Under the conditions shown in Table 12, tapping tests were run. The maximum wear VB_max of the relief surface of the cutting edge of the starting point of machining after 2000 pieces was used as an evaluation index to evaluate the tool lifetime when machining the steel materials of the invention examples and comparative examples. The tests were run using water-insoluble cutting fluids.

TABLE 12

| | | |
|---|---|---|
| Machining conditions | Speed | 10 m/min |
| | Bottom hole | φ5 × 15 mm (stop hole) |
| | Tapping length | 10 mm |
| | No. cut | 2000 pieces |
| Tool | Material | TiC coated high speed steel |
| | Size | M6 × 1 OH2 2.5 P |

Under the conditions shown in Table 13, gear cutting simulated intermittent machining tests were run using no tools. The maximum wear VB_max of the relief surface after machining 18 m was used as an evaluation index to evaluate the tool lifetime when machining the steel materials of the invention examples and comparative examples. The tests were run using water-insoluble cutting fluids and dry lubricating conditions.

TABLE 13

| | | |
|---|---|---|
| Machining conditions | Speed | 100 m/min |
| | Feed | 0.28 mm/rev |
| | Cutting depth | 4.5 mm |
| | Cutting length | 18 m |
| Tool | Material | TiAlN coated high speed steel |

Tables 1 to 4 show the results of drill boring tests under the conditions of Table 9 in tools comprised of base materials of TiAlN coated cemented alloys coated by various metal oxides.

Invention Example Nos. 1 to 78 were in the range of the present invention and had large numbers of holes drilled before breakage. That is, superior tool lifetimes were obtained.

Comparative Example Nos. 79 to 83 had a total Al content outside the range of the present invention, so had inferior tool lifetime compared with the invention examples.

Comparative Example No. 84 had a total Al content outside the range of the present invention, so did not satisfy [Al %]−(27/14)×[N %]≥0.05%, so had inferior tool lifetime compared with the invention examples.

Comparative Example Nos. 85 to 87 had free energies of formation of oxides of the metal oxides of the tool surface layer below the free energy of formation of oxides of $Al_2O_3$, that is, −782 kJ, or outside the range of the present invention, so had inferior tool lifetimes compared with the invention examples.

Comparative Example No. 88 did not have a metal oxide coating on the surface layer of the tool, so had an inferior tool lifetime compared with the invention examples.

Table 5 shows the results of drill boring tests under the conditions of Table 10 in tools comprised of base materials of high speed steel coated with various metal oxides.

Invention Example Nos. 89 to 97 were in the range of the present invention and had large VL1000's. That is, superior tool lifetimes were obtained.

Comparative Example Nos. 98 and 99 had total Al contents of the steel materials outside the range of the present invention, so had inferior tool lifetimes compared with the invention examples.

Comparative Example No. 100 had a total Al content in the range of the present invention, but did not satisfy [Al %]−(27/14)×[N %]≥0.05%, so had inferior tool lifetime compared with the invention examples.

Comparative Example No 101 had a free energy of formation of oxides of the metal oxides of the tool surface layer below the free energy of formation of oxides of $Al_2O_3$, that is, −782 kJ, or outside the range of the present invention, so had inferior tool lifetime compared with the invention examples.

Comparative Example No. 102 did not have a metal oxide coating on the surface layer of the tool, so had an inferior tool lifetime compared with the invention examples.

Table 6 shows the results of longitudinal turning tests under the conditions of Table 11 in tools comprised of base materials of cemented alloy coated with various metal oxides.

Invention Example Nos. 103 to 116 were in the range of the present invention, had small maximum wears VB_max of the relief surfaces, and gave superior tool lifetimes.

Comparative Example Nos. 117 and 118 had total Al contents of the steel materials outside the range of the present invention, so had greater extents of wear and inferior tool lifetimes compared with the invention examples.

Comparative Example No. 119 had a total Al content in the range of the present invention, but did not satisfy [Al %]−(27/14)×[N %]≥0.05%, so had a greater extent of wear and inferior tool lifetime compared with the invention examples.

Comparative Example No. 120 had a free energy of formation of oxides of the metal oxides of the tool surface layer below the free energy of formation of oxides of $Al_2O_3$, that is, −782 kJ, or outside the range of the present invention, so had a larger extent of wear and inferior tool lifetime compared with the invention examples.

Comparative Example No. 121 did not have a metal oxide coating on the surface layer of the tool, so had an inferior tool lifetime compared with the invention examples.

Table 7 shows the results of tapping tests under the conditions of Table 12 in tools comprised of base materials of TiC coated high speed steel coated with various metal oxides.

Invention Example Nos. 122 to 133 were in the range of the present invention, had small maximum wears VB_max of the relief surfaces, and gave superior tool lifetimes.

Comparative Example Nos. 134 and 135 had total Al contents of the steel materials outside the range of the present invention, so had greater extents of wear and inferior tool lifetimes compared with the invention examples.

Comparative Example No. 136 had a total Al content in the range of the present invention, but did not satisfy [Al %]−(27/14)×[N %]≥0.05%, so had a greater extent of wear and inferior tool lifetime compared with the invention examples.

Comparative Example No. 137 had a free energy of formation of oxides of the metal oxides of the tool surface layer below the free energy of formation of oxides of $Al_2O_3$, that is, −782 kJ, or outside the range of the present invention, so had a larger extent of wear and inferior tool lifetime compared with the invention examples.

Comparative Example No. 138 was not provided with an oxide coating on the surface layer of the tool, so had inferior tool lifetime compared with the invention examples.

Table 8 shows the results of gear cutting tests under the conditions of Table 13 in tools comprised of base materials of TiAlN coated high speed steel coated with various metal oxides.

Invention Example Nos. 139 to 150 were in the range of the present invention, had small maximum wears VB_max of the relief surfaces, and gave superior tool lifetimes.

Comparative Example Nos. 151 and 152 had total Al contents of the steel materials outside the range of the present invention, so had greater extents of wear and inferior tool lifetimes compared with the invention examples.

Comparative Example No. 153 had a total Al content in the range of the present invention, but did not satisfy [Al %]−(27/14)×[N %]≥0.05%, so had a greater extent of wear and inferior tool lifetime compared with the invention examples.

Comparative Example No. 154 had a free energy of formation of oxides of the metal oxides of the tool surface layer below the free energy of formation of oxides of $Al_2O_3$, that is, −782 kJ, or outside the range of the present invention, so had a larger extent of wear and inferior tool lifetime compared with the invention examples.

Comparative Example No. 155 was not provided with an oxide coating on the surface layer of the tool, so had an inferior tool lifetime compared with the invention examples.

Above, examples were explained. As will be understood from the examples, in the present invention, an improvement in tool lifetime can be obtained in drilling, longitudinal turning, tapping, or other continuous machining or simulated gear cutting and other such intermittent machining and further under all sorts of lubricated states such as water-insoluble cutting fluids, water-soluble cutting fluids, dry states, etc.

What are given as examples as the steel for machine structure use and machining of the same are just illustrations. The gist of the present invention is not limited to these.

INDUSTRIAL APPLICABILITY

According to the present invention, it is possible to provide steel for machine structure use excellent in lubricating ability and tool lifetime in a broad range of cutting speeds regardless of continuous machining, intermittent machining, or other systems and further in various machining environments such as use of a cutting fluid and a dry, semidry, and oxygen enriched environment and a machining method of the same, so the contribution to the machine industry is great.

REFERENCE SIGNS LIST

21 high speed steel
22 $Fe_3O_4$ coating
23 $Al_2O_3$ coating
24 scraps (mainly Fe)
31 cemented alloy
32 TiAlN coating
33 $TiO_2$ coating

The invention claimed is:

1. A method for machining steel with a cutting tool, the steel containing, by mass %, C: 0.2 to 1.2%,
Si: 0.005 to 3.0%,
Mn: 0.05% to 3.0%,
P: 0.0001 to 0.2%,
S: 0.001 to 0.092%,
Al: more than 0.1 and not more than 0.5%, and
N: 0.0005 to 0.035%,
satisfying

[Al %]−(27/14)×[N %]≥0.05%, and having a balance of Fe and unavoidable impurities, wherein the cutting tool comprises a surface, the surface being coated with a metal oxide of a metal element selected from the group consisting of Mn, Fe, Co, Ni, Cu, Nb, Mo, Ta, W, Si, Zn, and Sn or metal oxides of two or more of these metal elements, and wherein the steel does not contain Te, and the method comprising a step of machining the steel with the cutting tool while undergoing a chemical reaction due to solute Al in the steel and the metal oxides at the tool surface, thereby obtaining an $Al_2O_3$ coating on the tool surface.

2. A method for machining steel according to claim 1, wherein said steel further contains, by mass %, Ca: 0.0001 to 0.02%.

3. A method for machining steel according to claim 1 or 2, wherein said steel further contains, by mass %, one or more of Ti: 0.0005 to 0.5%,
Nb: 0.0005 to 0.5%,
W: 0.0005 to 1.0%,
V: 0.0005 to 1.0%,
Ta: 0.0001 to 0.2%,
Hf: 0.0001 to 0.2%,
Cr: 0.001 to 3.0%,
Mo: 0.001 to 1.0%,
Ni: 0.001 to 5.0%, or
Cu: 0.001 to 5.0%.

4. A method for machining steel according to claim 1 or 2, wherein said steel further contains, by mass %, one or more of Mg: 0.0001 to 0.02%,
Zr: 0.0001 to 0.02%, or
Rem: 0.0001 to 0.02%.

5. A method for machining steel according to claim 3, wherein said steel further contains, by mass %, one or more of Mg: 0.0001 to 0.02%,
Zr: 0.0001 to 0.02%, or
Rem: 0.0001 to 0.02%.

6. A method for machining steel according to claim 1 or 2, wherein said steel further contains, by mass %, one or more of Sb: 0.0001 to 0.015%,
Sn: 0.0005 to 2.0%,
Zn: 0.0005 to 0.5%,
B: 0.0001 to 0.015%,
Se: 0.0003 to 0.2%,
Bi: 0.001 to 0.5%,
Pb: 0.001 to 0.5%,
Li: 0.00001 to 0.005%, Na: 0.00001 to 0.005%,
K: 0.00001 to 0.005%,
Ba: 0.00001 to 0.005%, or
Sr: 0.00001 to 0.005%.

7. A method for machining steel according to claim 3, wherein said steel further contains, by mass %, one or more of Sb: 0.0001 to 0.015%,
Sn: 0.0005 to 2.0%,
Zn: 0.0005 to 0.5%,
B: 0.0001 to 0.015%,
Se: 0.0003 to 0.2%,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, or
Sr: 0.00001 to 0.005%.

8. A method for machining steel according to claim 4, wherein said steel further contains, by mass %, one or more of Sb: 0.0001 to 0.015%,
Sn: 0.0005 to 2.0%,
Zn: 0.0005 to 0.5%,
B: 0.0001 to 0.015%,
Se: 0.0003 to 0.2%,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, or
Sr: 0.00001 to 0.005%.

9. A method for machining steel according to claim 5, wherein said steel further contains, by mass %, one or more of Sb: 0.0001 to 0.015%,
Sn: 0.0005 to 2.0%,
Zn: 0.0005 to 0.5%,
B: 0.0001 to 0.015%,
Se: 0.0003 to 0.2%,
Bi: 0.001 to 0.5%,
Pb: 0.001 to 0.5%,
Li: 0.00001 to 0.005%,
Na: 0.00001 to 0.005%,
K: 0.00001 to 0.005%,
Ba: 0.00001 to 0.005%, or
Sr: 0.00001 to 0.005%.

10. A method for machining steel according to claim 1 or 2, wherein said cutting tool coated with said metal oxides on the surface contacting the machined material is fabricated by either PVD or CVD.

11. A method for machining steel according to claim 1 or 2, wherein the thickness of the metal oxides coated on said cutting tool is 50 nm to less than 1 μm.

12. A method for machining steel according to claim 1 or 2, wherein in said machining, a cutting fluid or other lubrication oil is used.

13. A method for machining steel according to claim 12, wherein said cutting fluid or other lubrication oil is a water-insoluble cutting fluid.

14. A method for machining steel according to claim 1 or 2, wherein said cutting is continuous machining.

* * * * *